US007520828B2

(12) United States Patent
Tucker, Sr. et al.

(10) Patent No.: US 7,520,828 B2
(45) Date of Patent: Apr. 21, 2009

(54) LACROSSE HEAD HAVING A FLEXIBLE STRINGING MEMBER AND A RECESSED SCOOP

(75) Inventors: Richard B. C. Tucker, Sr., Ruxton, MD (US); Joel F. Price, Chevy Chase, MD (US)

(73) Assignee: STX, LLC, Baltimore, MD (US)

( * ) Notice: Subject to any disclaimer, the term of this patent is extended or adjusted under 35 U.S.C. 154(b) by 432 days.

(21) Appl. No.: 11/345,321

(22) Filed: Feb. 2, 2006

(65) Prior Publication Data

US 2006/0194655 A1 Aug. 31, 2006

Related U.S. Application Data

(60) Provisional application No. 60/648,688, filed on Feb. 2, 2005.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/723
See application file for complete search history.

(56) References Cited

U.S. PATENT DOCUMENTS 2,075,372 A * 3/1937 Taylor ..... 473/513
2,710,753 A * 6/1955 Lockwood ..... 473/513
4,153,251 A 5/1979 Pond
4,938,480 A 7/1990 Lods
5,037,112 A 8/1991 Brine, III et al.
5,938,550 A * 8/1999 Hexemer et al. ..... 473/513
6,213,901 B1 4/2001 Collinson
6,447,410 B2 9/2002 Crawford
6,506,132 B1 1/2003 Brine, III et al.
6,520,875 B1 2/2003 Crawford
6,676,547 B1 * 1/2004 Morrow et al. ..... 473/513
6,852,047 B2 2/2005 Tucker, Sr.
6,916,259 B2 7/2005 Kohler et al.

* cited by examiner

*Primary Examiner*—Gene Kim
*Assistant Examiner*—M Chambers
(74) *Attorney, Agent, or Firm*—Paul, Hastings, Janofsky & Walker LLP

(57) ABSTRACT

A lacrosse head having at least one of a flexible stringing member and a recessed scoop is provided. In one embodiment, a slot is formed in a head along a stop member, a sidewall, and/or a scoop to provide the flexible stringing member. In another embodiment, the flexible stringing member is a flexible stringing bar that extends from a stop member to a scoop. In another embodiment, the flexible stringing member is more flexible in one direction than another. Through these embodiments, a flexible stringing member can dampen and dynamically narrow the pocket, enhance ball retention, increase pass/shot accuracy, and satisfy pocket-forming preferences. In another embodiment, a scoop has a recess that curves toward a stop member to increase the amount of surface area that contacts a ball when scooping.

29 Claims, 18 Drawing Sheets

LACROSSE HEAD HAVING A FLEXIBLE STRINGING MEMBER AND A RECESSED SCOOP

This application claims the benefit of U.S. Provisional Application No. 60/648,688, filed Feb. 2, 2005, which is incorporated herein by reference in its entirety.

BACKGROUND

1. Field of the Invention

The present invention relates generally to lacrosse sticks, and more particularly, to a lacrosse stick head having at least one of a flexible stringing member and a recessed scoop.

2. Background of the Invention

FIG. 1 illustrates a conventional lacrosse stick 100 having a handle 102 shown in dotted lines and a double-wall synthetic head 104. Head 104 comprises a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. As shown, handle 102 fits into and through juncture 106, and abuts stop member 1114. A screw or other fastener placed through opening 107 secures handle 102 to head 104.

For traditionally-strung pockets (which have thongs and string instead of mesh), thongs (not shown) made of leather or synthetic material extend from upper thong holes 116 in transverse wall 112 to lower thong holes 118 in stop member 114. In some designs, such as the design shown in FIG. 1, upper thong holes 116 are located on tabs 117 of the scoop 112. On other designs, upper thong holes 116 are located directly on the scoop 112. FIG. 1 shows four pairs (116, 118) of thong holes that accept four thongs. To complete the pocket web, nylon strings are threaded around the thongs and string is laced through string holes 120 in sidewalls 108 and 110, forming any number of diamonds (crosslacing). Finally, one or more throwing or shooting strings extend transversely between the upper portions of sidewalls 108 and 110, attaching to throwing string holes 124 and a string laced through string holes 122. A handle or shaft 102 is disposed in juncture 106 of head 104 and is secured to head 104 with a screw or similar fastener placed in opening 107. The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

Conventional rigid lacrosse heads that string the pocket directly to the rigid frame frustrate a manufacturer's ability to satisfy divergent performance characteristics. For example, to provide better ball control during face-offs or when scooping ground balls, a player may prefer a strong but deformable lacrosse head that returns to its original shape once the deforming force is removed. At the same time, a player may desire a less rigid, vibration-dampening lacrosse head that absorbs impacts to the lacrosse head by other sticks to help prevent a ball from being jarred from the head. With a conventional rigid head that strings the pocket directly to the rigid frame, the manufacturer must choose a material that serves both of these disparate purposes. Although the manufacturer can compensate somewhat for this performance tradeoff by using structural elements (e.g., increasing the thickness of the sidewalls), the practical result of the tradeoff is a lacrosse head that satisfies neither purpose optimally.

There are many other examples of these types of tradeoffs in choosing a material for a conventional rigid lacrosse head. For example, providing the necessary rigidity in a lacrosse head can compromise the ability to provide a dampening pocket. In an effort to deepen a pocket as much as possible, some conventional men's lacrosse heads maximize the height of the sidewalls to the upper limit of 2 inches that is mandated by applicable rules. Unfortunately, maximizing the height of the traditional rigid sidewall does not enhance the flexibility of the pocket in any way. The rigid frame of the traditional lacrosse head can make the overall catching area stiff and unforgiving. Indeed, the only non-rigid component of the conventional men's lacrosse head is the pocket. A sharp jolt to the stick, as often happens when a player is checked, can cause the stiff frame to jerk the pocket and propel the ball out of the lacrosse head. Players would therefore prefer a less rigid lacrosse head that better dampens the pocket to keep a ball in the lacrosse head.

Another example of a performance tradeoff concerns the rigidity of the lacrosse head frame in relation to the tightness of the pocket strings. With conventional rigid lacrosse heads that attach the pocket directly to the rigid frame, the stiffer the material of the head, the less the head flexes or "gives" in response to tension on the pocket. As a result, the pocket in a women's lacrosse head can become excessively tight, such that impact with the ball causes a trampoline effect that makes the ball hard to catch and control. In essence, the pocket, strung on a rigid unforgiving frame, acts like the strings of a tennis racquet and rebounds the ball out of the pocket. This trampoline effect is especially troublesome for women's lacrosse sticks, which have shallower and more tightly strung pockets than men's lacrosse sticks. Again, restricted to a rigid head that attaches the pocket directly to the rigid frame, a manufacturer could use a more energy absorbing material to reduce the trampoline effect. However, using a more energy absorbing material can make the head less rigid and less suitable for accurate passing and shooting, and for protecting against ball-jarring hits.

Thus, there remains a need for a lacrosse head that better satisfies the divergent performance requirements discussed above. In particular, there remains a need for a lacrosse head that possesses the necessary structural support while also satisfying preferences for pocket dampening, ball control and retention, protective cushioning, and light weight.

SUMMARY OF THE INVENTION

An embodiment of the present invention provides a lacrosse stick having at least one of a flexible stringing member and a recessed scoop.

In one embodiment of the present invention, a slot is formed in a lacrosse head along a stop member, a sidewall, and/or a scoop to provide the flexible stringing member. When provided at the scoop, the scoop and the flexible stringing member can overlap each other such that no through passage is visible through the slot when viewed in a direction facing a ball receiving side of the head. The flexible stringing member and lacrosse head frame can also have aligned holes separated by a gap, with the holes configured to receive an attachment member that adjusts the size of the gap. The flexible stringing member provided by the slot can move in multiple directions relative to the lacrosse head frame to provide both dampening and narrowing of the pocket.

In another embodiment, the flexible stringing member is a flexible stringing bar that extends from a stop member to a scoop. A flexible stringing bar can be provided adjacent to each sidewall, with the pocket attached to the bars. In this manner, when a ball is received into the pocket the flexible stringing bars can move toward each other to dynamically narrow the pocket, while also dampening the pull of the pocket. This dampening and narrowing greatly enhances ball control and retention.

In another embodiment, the flexible stringing member is more flexible in one direction than another. For example, the flexible stringing member can flex more in a first direction generally from the ball receiving side of the lacrosse head toward the ball retaining side of the lacrosse head than in a second direction generally from the ball retaining side of the lacrosse head toward the ball receiving side of the lacrosse head. The greater flexibility in the first direction dampens the pocket and improves ball control. The lesser flexibility in the second direction improves passing and shooting accuracy by providing a contoured pocket against which the ball can rise and release.

Another embodiment of the present invention provides upper sidewalls that are independent of a flexible lower sidewall member. The lower sidewall member can have a crosspiece that connects two lower sidewall members. The flexible stringing member can lay over the crosspiece for further support and/or flexibility. The lower sidewall member can be disposed outwardly of the upper sidewalls to absorb impacts before the upper sidewalls.

In another embodiment of the present invention, a lacrosse head has a recess in the scoop that curves toward the stop member to increase the amount of surface area that underlies and contacts a ball when scooping.

DETAILED DESCRIPTION OF THE INVENTION

Figure 1:
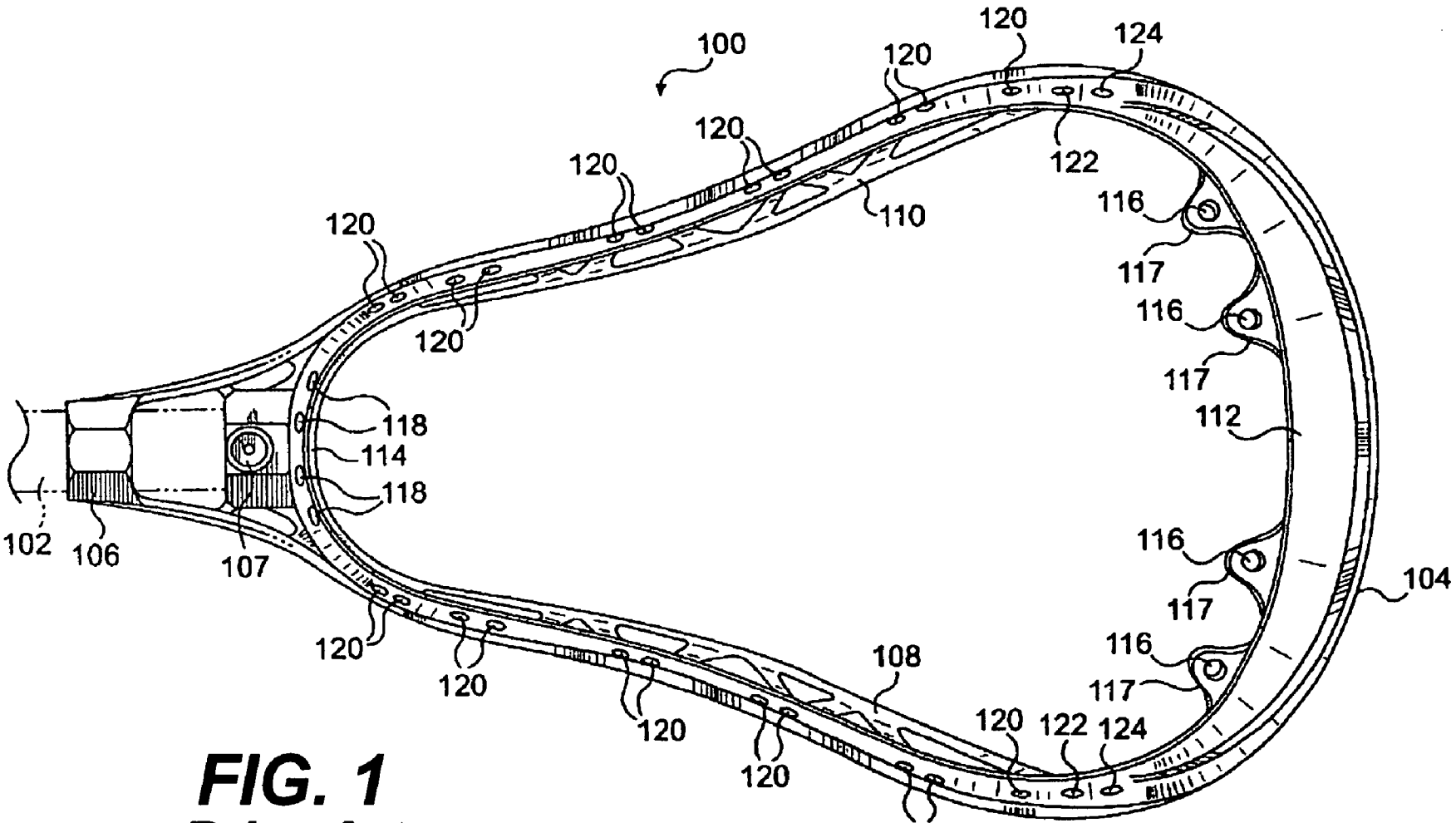
FIG. 1 Prior Art
FIG. 1 is a schematic diagram of a lacrosse stick.

An embodiment of the present invention provides a lacrosse head having a flexible stringing member, for example, in at least one of the stop member, the sidewalls, and the scoop. The flexible stringing member provides additional "spring" or "give," especially while catching and cradling, but without sacrificing too much movement in the reverse shooting direction. As used herein, a flexible stringing member refers to a member that, in response to a force such as the pull of a pocket from catching or cradling a regulation lacrosse ball, moves a greater distance than the main lacrosse head frame.

FIGS. 2-7 show an exemplary lacrosse stick 200 with a head 204 having flexible stringing rails 226 in the sidewalls 208, 210 and a flexible stringing rail 232 in the scoop 212. Both of these flexible rails 226, 232 in the sidewalls 208, 210 and the scoop 212 can be limited in their motion toward the ball receiving side of the head 204 by the main frame 237 (e.g., about 0.020 inches toward the inside taper ends of the slot openings 228, 234), but are able to flex or move away much farther (e.g., greater than 0.090 inches) from the main frame 237 when, for example, pulled by the pocket strings (not shown) in a direction toward the ball retaining side of head 204.

Figure 3:
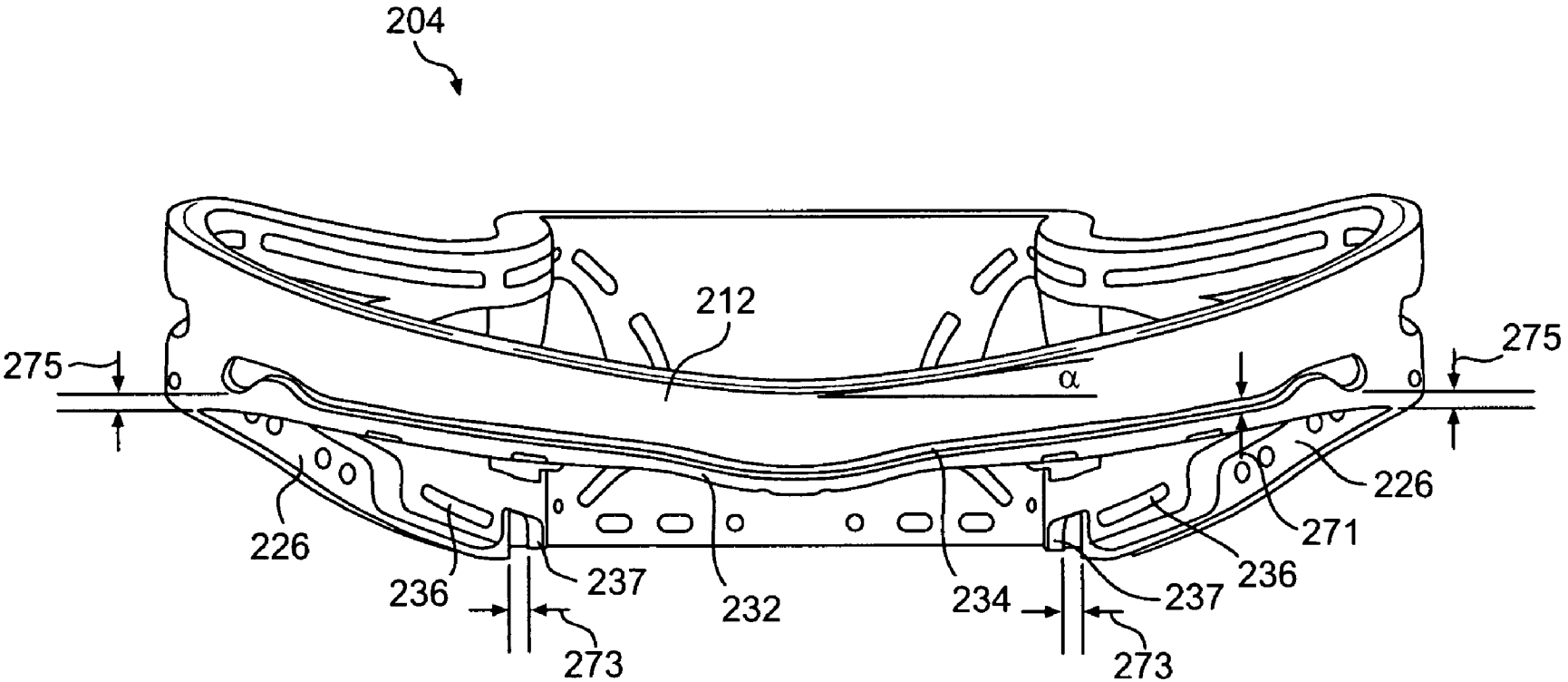
FIG. 3 is a schematic diagram illustrating an end view of an exemplary lacrosse head having a flexible stringing rail along a recessed scoop according to an embodiment of the present invention.

In an alternative embodiment, the motion of the flexible rails 226, 232 is not limited in any direction, which can be accomplished, for example, by providing a larger slot opening 228, 234. In another alternative embodiment, the flexible rails 226 can be disposed inwardly of the main frame 237, rather than outwardly as is shown in FIG. 3, so that the flexible rails 226 are unimpeded in a direction toward the interior of head 204.

The ends of the slot openings 228, 234 may be teardrop shaped 230, 235 so as to minimize the stress points during flexure of the plastic material at the end points where the flexible stringing rails 226, 232 are attached to the main frame 237. In one embodiment, in the scoop 212, the slot opening 234 is about 7.2 inches long and about 0.05 inches wide (as represented by dimension 271 in FIG. 3), with a 2 degree taper inward (toward the interior of head 204) and rounded edges, as is best shown in FIG. 3. The teardrop shapes 230, 235 at the ends of the slot are approximately 0.3 inches in diameter and the amount of material between the bottom of the teardrop shapes 230, 235 and the outside of the scoop 212 is approximately 0.12 inches (as represented by dimension 275). This amount of material can be increased or decreased, as desired, to permit more or less flexure of the material at those end points respectively.

Figure 4:
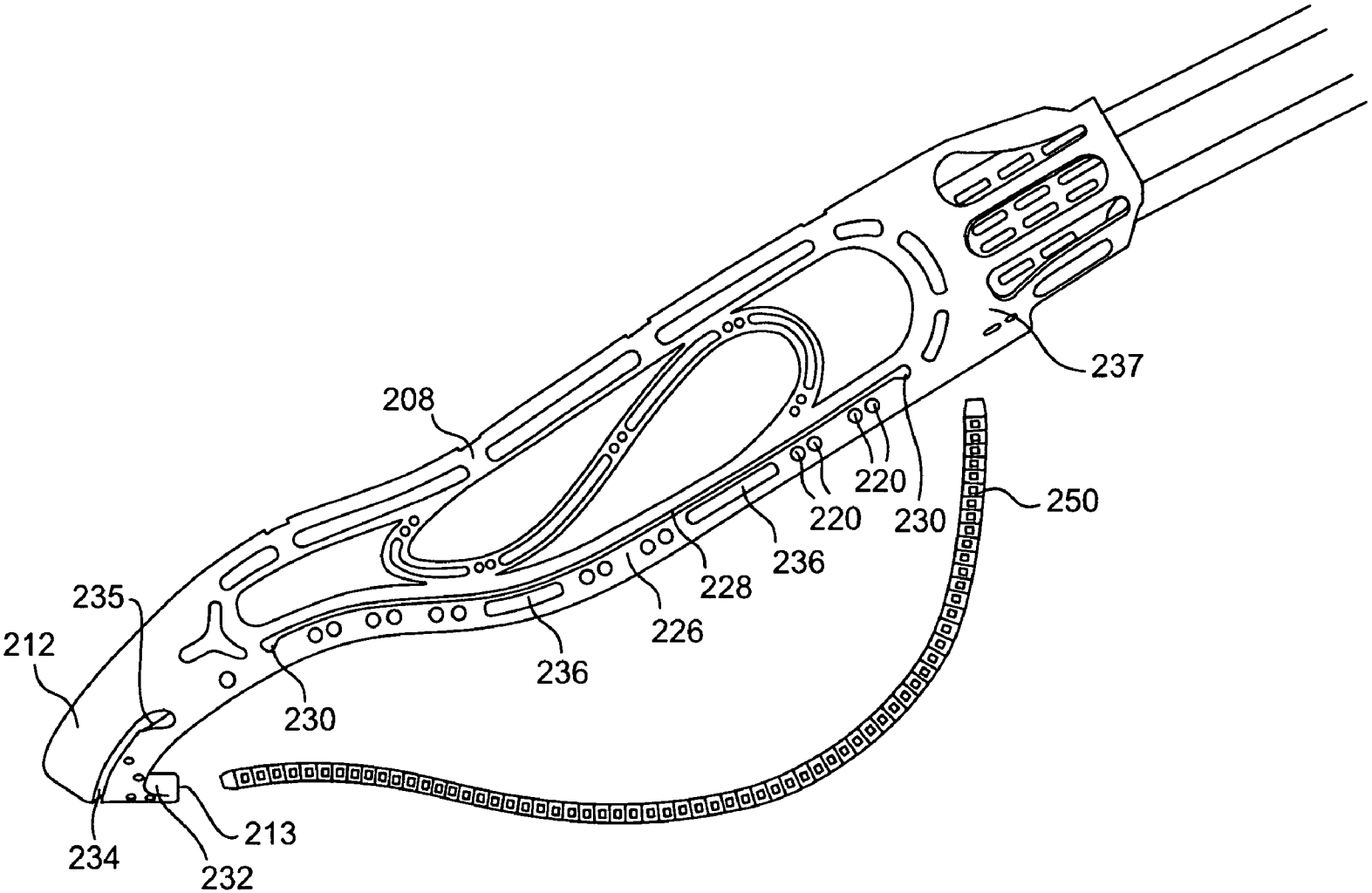
FIG. 4 is a schematic diagram illustrating a side view of an exemplary lacrosse stick having flexible stringing rails, a recessed scoop, and a flexible pocket member, according to an embodiment of the present invention.

In another embodiment, in the sidewall, the slot opening 228 is about 7 inches long measured along a straight line from end point to end point and is about 0.03 inches wide, with a 2 degree taper inward (toward the interior of the head), when viewed from a side elevation as in FIG. 4. When viewed from the bottom as in FIG. 6, the slot 228 is about 0.05 inches wide with a 2 degree taper toward the ball receiving side of the lacrosse head frame. The teardrop shapes 230 (see FIG. 4) at the ends of the slot 228 are approximately 0.18 inches in diameter and the amount of material between the bottom of the teardrop shapes 230 and the outside of the main frame 237 is approximately 0.12 inches. This amount of material can be increased or decreased, as desired, to permit more or less flexure of the material at those end points respectively.

Figure 7:
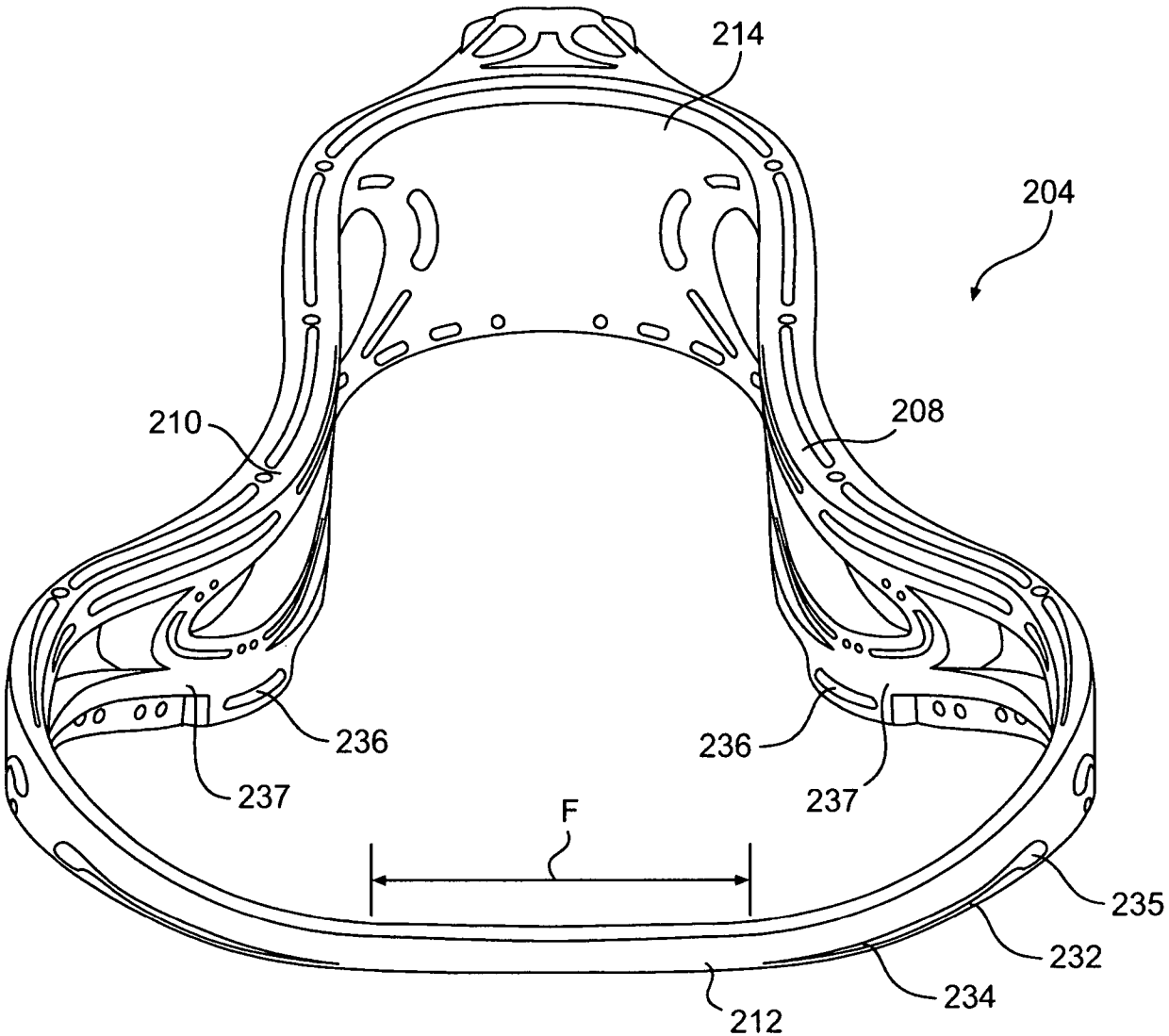
FIG. 7 is a schematic diagram illustrating a perspective end view of an exemplary lacrosse head having flexible stringing rails and a recessed scoop, according to an embodiment of the present invention.

As shown best in FIG. 5A, on the flexible rail 232 of the scoop 212, floating string attachments 217 (six in this example, but could be two or more) can be below the surface of the main scoop 212 even during full closure of the slot opening 234. The floating string attachments 217 can be constructed as described in U.S. Pat. No. 6,852,047, issued to Tucker, Sr., which is herein incorporated by reference in its entirety. The slot opening 234 at the 30 degree scooping plane is mainly behind the front scoop surface 212 so as to minimize the potential of catching a lip of the moving flexible rail 234 during ball retrieval on the ground. For example, as shown in FIG. 7, within a flat section F (e.g., 2.5 inches in width) of the scoop 212, the slot opening 234 can be "hidden" from the ground contact surface. In addition, as shown best in FIG. 5A, the scoop 212 and flexible rail 234 can overlap each other such that no through passage is visible through the slot when viewed in a direction facing a ball receiving side of the head.

As shown in FIG. 7, the flat section F may define a plane that forms an angle with the shaft axis of the head 204 of between approximately 20 to 40 degrees. Thus, the flat section F would lie flat against the ground when a player approaches a ball with the stick held at that angle, the approach angle depending on the specific size of the player and their playing style.

Figure 5A:
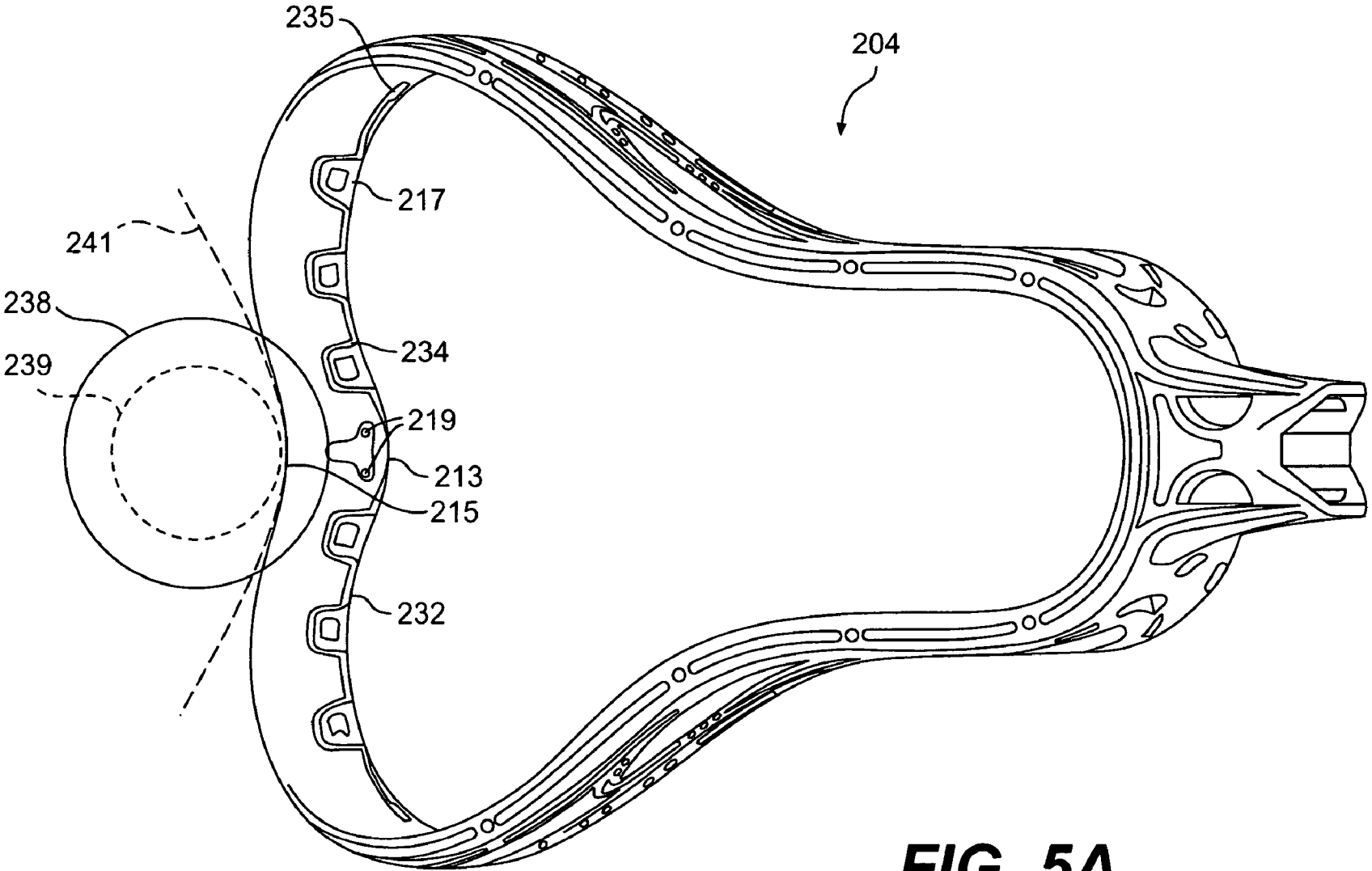
FIG. 5A is a schematic diagram illustrating a top view of a ball receiving side of an exemplary lacrosse head having a flexible stringing rail along a recessed scoop, according to an embodiment of the present invention.

As shown, for example, in FIGS. 4 and 5A, the recessed or scalloped scoop 212 having recessed edge 215 and inwardly extending edge 213 enables the main scoop 212 to be farther underneath a ball 238 during the natural scooping motion. This configuration facilitates easier ball retrieval, as compared to the traditional scoop shape 112 (as shown in FIG. 1) in which the uppermost point of the scoop (farthest from the base) contacts the ball, and the portions of the scoop adjacent to the uppermost point curve back away from the ball. Indeed, with the traditional scoop 112 only a limited portion of the scoop is under the ball during scooping.

As shown in FIGS. 4 and 5A, with the scalloped scoop 212 design, upon initial contact with the ball 238, the scoop itself, and especially all of the surfaces to the left and right of the low point on the recess 215 or scalloped portion, are further underneath the ball 238. As an example, with a 2.5 inch diameter ball 238, 30 degree scoop plane, and approximately 1 inch wide scoop, the scoop 212 may contact the ball 238 at a diameter on the ball of about 1.62 inches (represented by the dotted contact diameter line 239), roughly 0.3 inches above the surface on which the ball 238 is resting. At this location, the recessed shape 215 of the scoop 212 approximates the curve of the ball 238 and a significant portion of the scoop 212 is underneath the ball 238. This recessed shape is generally represented by the dotted line 241, representing a compound curve, with a diameter greater than 2.5 inches. Thus, with a simple (shorter) downward motion on the handle 202 (or upward motion of the scoop end), the ball 238 is more easily controlled during entry into the head 204.

In addition, given that a player may not scoop a ball with the center of the ball perfectly on center with the head 204, the scalloped scoop design 212 can provide at least two points of contact with the ball 238 (and can provide more scoop initially farther underneath the ball) for easier pickup and control during entry into the head 204. For example, if the radius of curvature of the recessed scoop 212 is smaller than the radius of curvature of the contact diameter of the ball 238, then the recessed scoop 212 can contact the ball 238 at least at two points. Relative to the exemplary embodiment described above in which a representative contact diameter is approximately 1.62 inches (FIG. 5A), a radius of curvature of the recess could be approximately 0.9 inches or less. As a skilled artisan would appreciate, the appropriate radius of curvature of the recess would depend on the height at which the scoop contacts the ball, as determined by, for example, the angle and width of the scoop and the angle at which the stick is held relative to the ground when scooping the ball.

Figure 5B:
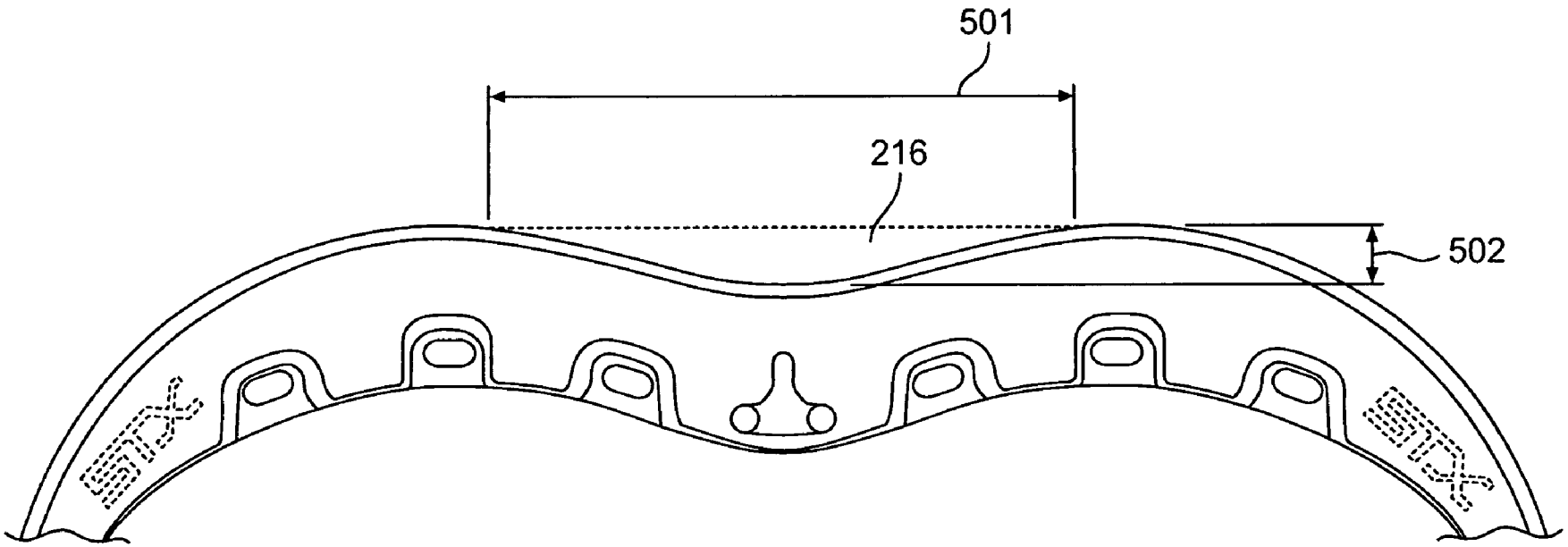
FIG. 5B is a schematic diagram illustrating an exemplary recessed scoop, according to an embodiment of the present invention.

FIG. 3 illustrates dimensions of an exemplary lacrosse head having a recessed scoop, according to an embodiment of the present invention. As shown, when viewed in a direction along the shaft axis, the angle of incline $\alpha$ of the scoop 212 from the center point of the scoop preferably is a maximum of approximately 30 degrees. As shown in FIG. 5B, when viewing the ball receiving side of the head, the recess area 216 can be about 0.2 to about 1.32 square inches. The width 501 of the recess area 216 could be about 0.3 to about 2.4 inches. The depth 502 of the recess area 216 (center point of scallop recess distance) could be about 0.2 inches to about 1.4 inches. The approximate area of the scoop 212 under a ball 238 (total left and right combined) could be about 0.02 to about 4.5 square inches.

Figure 6:
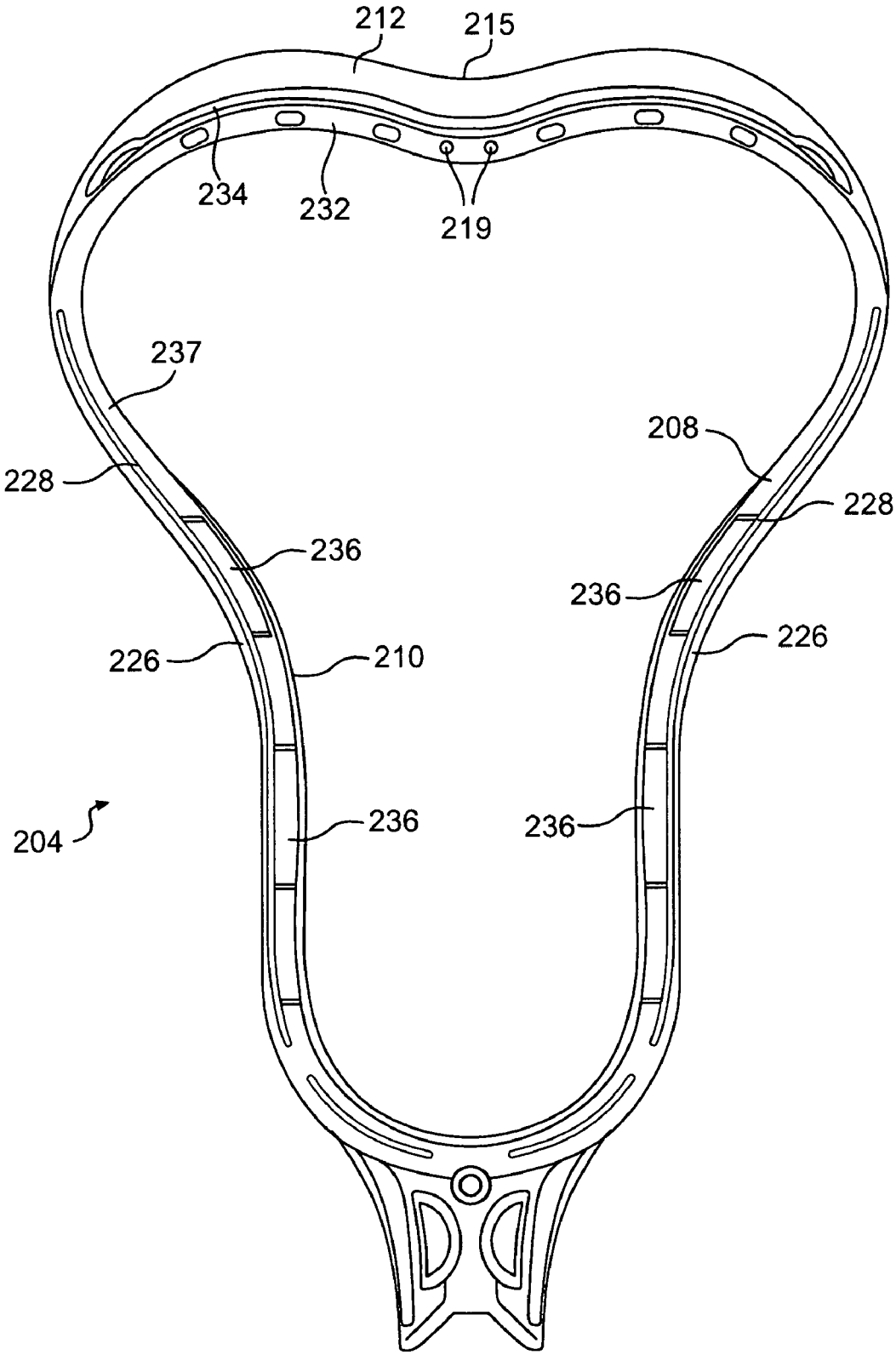
FIG. 6 is a schematic diagram illustrating a top view of a ball retaining side of an exemplary lacrosse head having a flexible stringing rail along a recessed scoop, according to an embodiment of the present invention.

As shown, for example, in the bottom view of FIG. 6 and in FIGS. 4 and 7, the flexible rails 232, 226 on the scoop 212 and sidewalls 208, 210 can also have aligned holes or slots 219, 236 through both the main frame 237 and the flexing rails 232, 226 to provide additional pocket adjustment. As shown best in FIG. 3, in this area, the main frame 237 and the flexible rails 226, 232 can be spaced apart by a gap of approximately 0.05 inches (as represented by dimensions 273) with a 2 degree taper toward the ball receiving side of head 204 and rounded edges. The spring wall adjustment string holes and slots 219, 236 can be used to connect the main frame 237 to the moving flexible rails 232, 226, to accommodate desired performance characteristics. On the scoop 212, there may be two holes 219 at the center that can be strung through either loosely, tightly, or not at all to adjust the permissible motion of the entire flexible scoop member 232. The flexible side rails 226 are shown with two similar slots 236 (could also be holes) that serve the same adjustability function with respect to the main frame 237 itself.

The flexible scoop rail 232 can be limited in motion toward the ball receiving side of the head by the more rigid main frame 237. Similarly, movement of the flexible side rails 226 may be limited toward the interior of head 204 by the main frame 237, limiting the potential for fracture during stick or body checks regularly delivered to the outside frame during lacrosse play. There are also openings 220 for attaching string members solely to the flexing side rail members 226.

Figure 2:
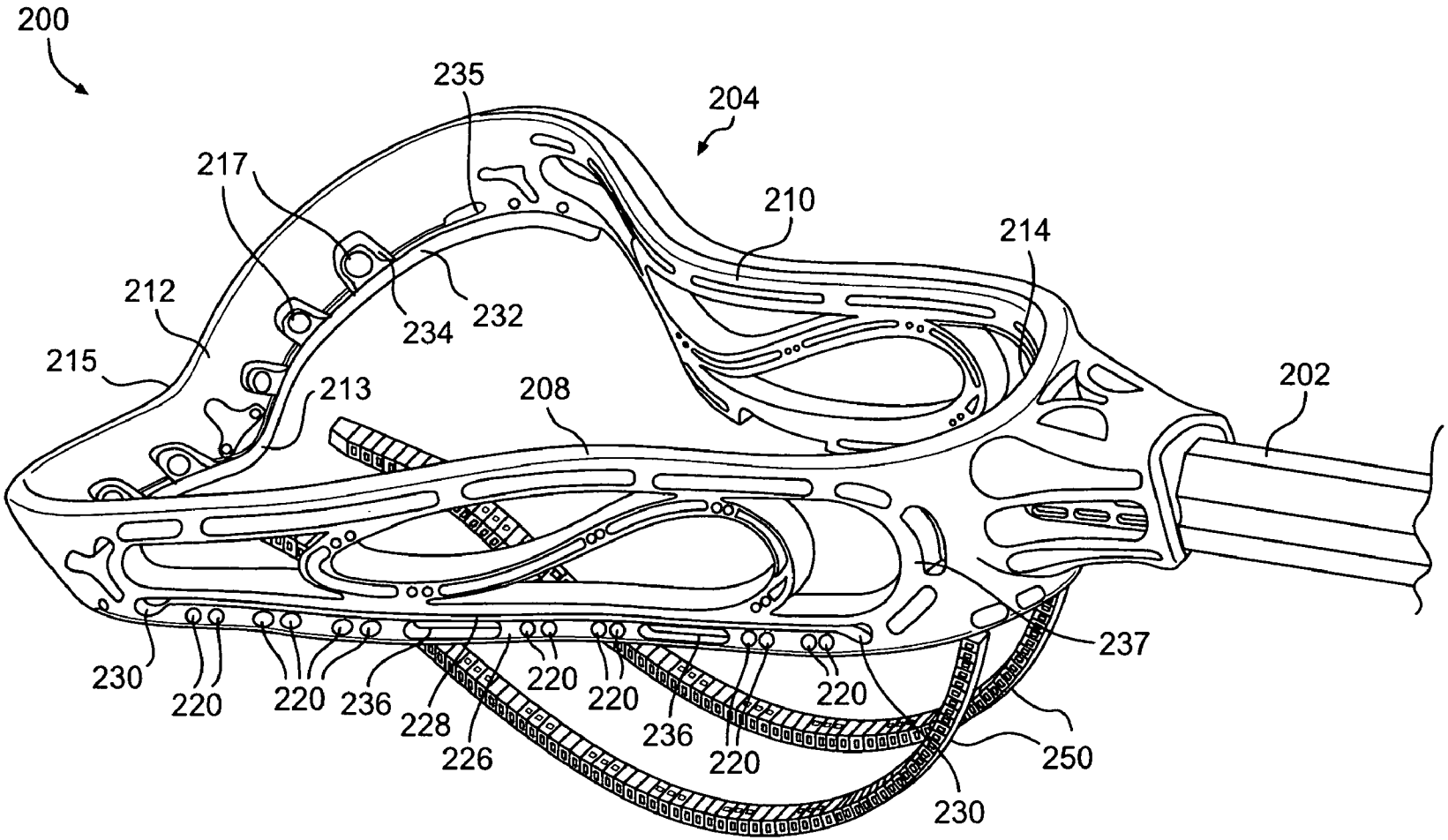
FIG. 2 is a schematic diagram illustrating a perspective view of an exemplary lacrosse stick having flexible stringing rails, a recessed scoop, and flexible pocket members, according to an embodiment of the present invention.

As shown in FIGS. 2 and 4, an exemplary lacrosse head in accordance with an embodiment of the present invention may include flexible pocket members 250 either in addition to or instead of the flexible stringing rails 226, 232. The flexible pocket members 250 may be configured to provide additional flexure upon impact with a ball being caught, thrown, or cradled. The flexible pocket members 250 can be formed of a material or a series of elements that is configured to be more flexible when forced in one direction (e.g., toward the ball retaining side of a head) and less flexible when forced in an opposite direction (e.g., toward the ball receiving side of a head). The flexible pocket members further provide a channel that guides the travel of the ball in and out of the pocket, to enable better ball control and more accurate throwing.

Figure 11:
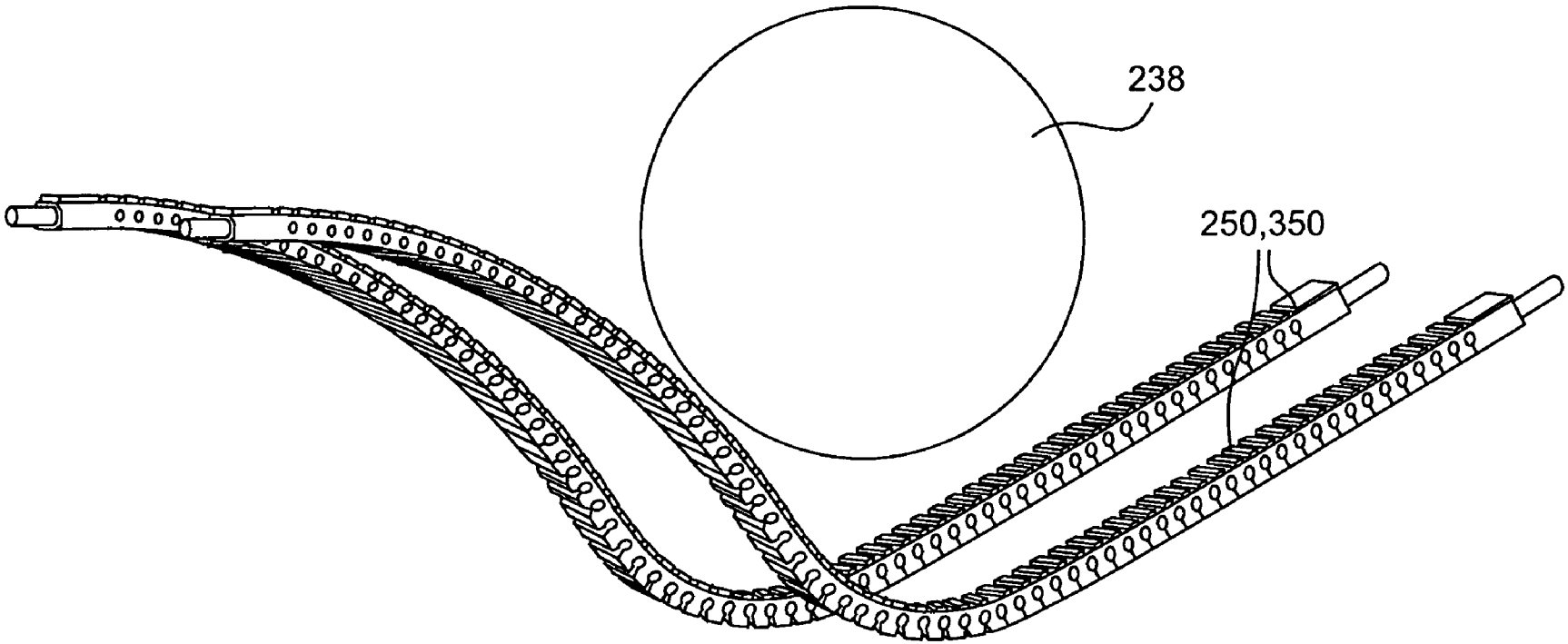
FIG. 11 is a schematic diagram illustrating a perspective view of flexible pocket members, according to another embodiment of the present invention.
Figure 12:
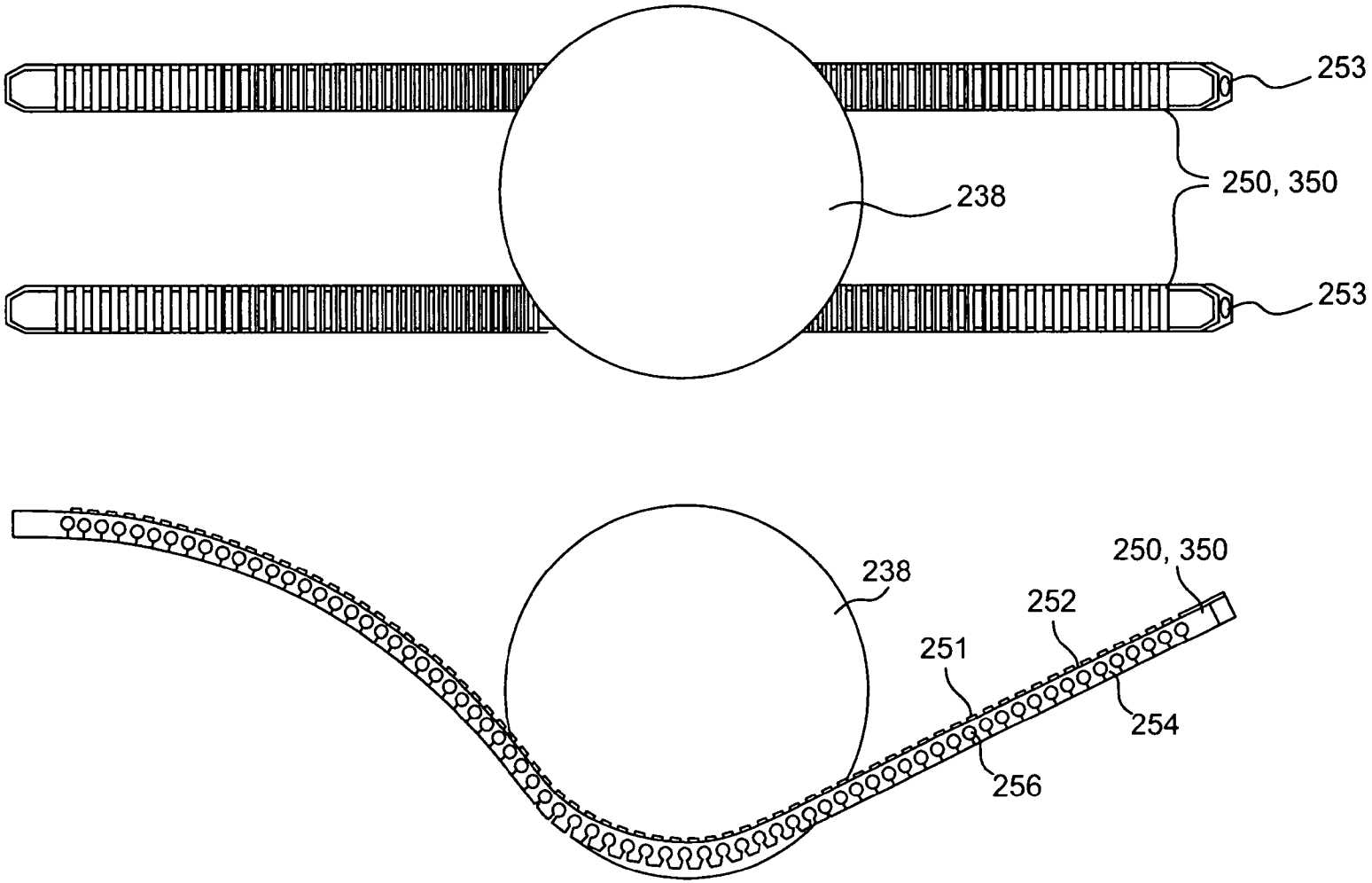
FIG. 12 is a schematic diagram illustrating top and side views of the flexible pocket members shown in FIG. 11, according to an embodiment of the present invention.
Figure 13:
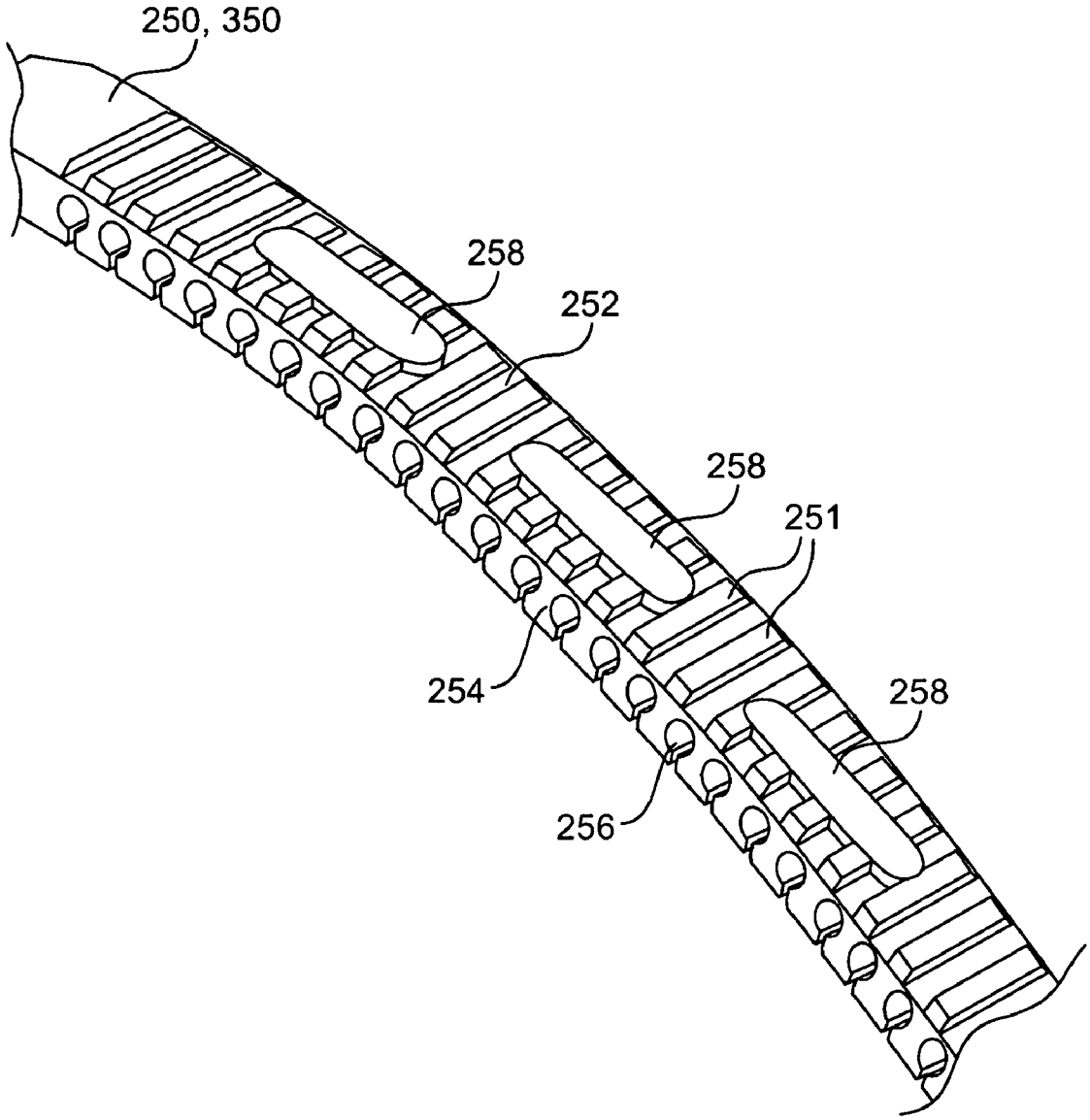
FIG. 13 is a schematic diagram illustrating a perspective view of flexible pocket members having additional slots, according to another embodiment of the present invention.

To provide flexible pocket members 250 that are more flexible in one direction and less in the opposite direction, the members 250 may be made of a continuous length of material such as that shown in FIGS. 11-13. As shown in FIG. 12, the member 250 is constructed such that the top portion 252 of member 250 is continuous while the bottom portion of member 250 comprises a plurality of separated protrusions 254 that extend downwardly from the top portion 252 and are in contact but not attached to one another. The protrusions 254 are shaped to just be in contact with one another when the flexible pocket member 250 is oriented in a straight line. Alternatively, the protrusions 254 can be configured to be oversized such that, instead of a straight line, the natural orientation (in the absence of other forces) of the flexible pocket member is to be concave when viewing a head from a side elevation. In another alternative, the protrusions 254 can be configured to be undersized such that the natural orientation of the flexible pocket member is convex when viewing a head from a side elevation.

In another embodiment, the protrusions may not touch each other when the member is in its natural orientation (e.g., concave, straight, or convex), to allow more flexibility when forced in a direction toward the ball receiving side of the head. In other words, when forced in a direction toward the ball receiving side of the head, the member would flex, and the protrusions would come together and eventually touch each other and prevent further flexing of the member.

In any of the above described embodiments of continuous flexible pocket member 250, lateral through-holes 256 may be provided that extend across the width of the member that allow strings to be threaded transversely through member 250 in order to form a pocket in the lacrosse head 204. Further, as shown in FIG. 13, slots 258 may be provided in the continuous flexible pocket members 250 transverse to through-holes 256. Slots 258 may be cut out of the top portion 252 of the flexible pocket members 250 and contribute to overall weight reduction and increased flexibility due to the removal of material. In addition, it is possible to thread pocket strings through the slots 258 and therefore provide additional stringing configurations.

Figure 10A:
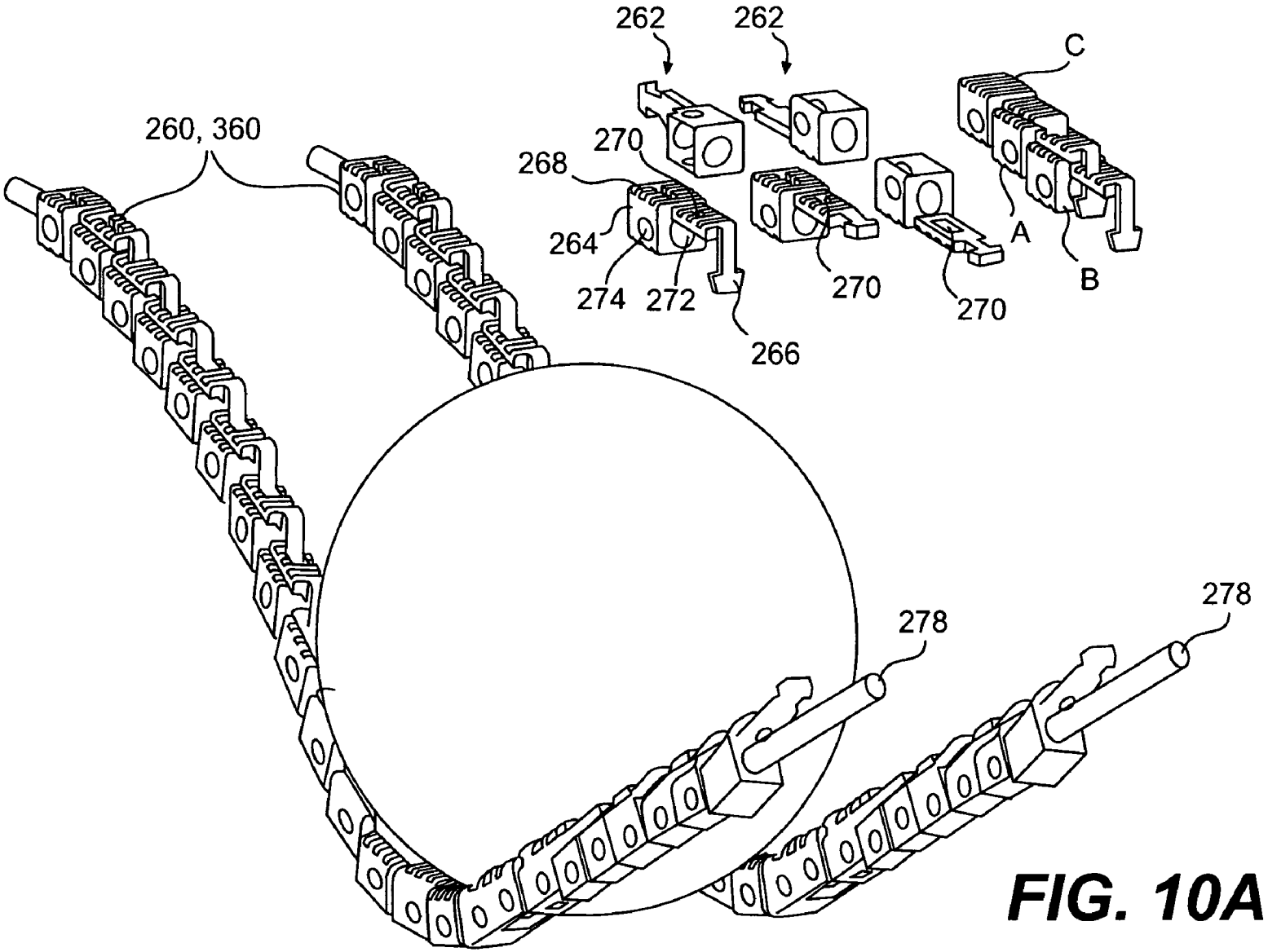
FIGS. 10A and 10B are schematic diagrams illustrating a perspective view of flexible pocket members, along with an exploded view of components of the flexible pocket members, according to an embodiment of the present invention.
Figure 10B:
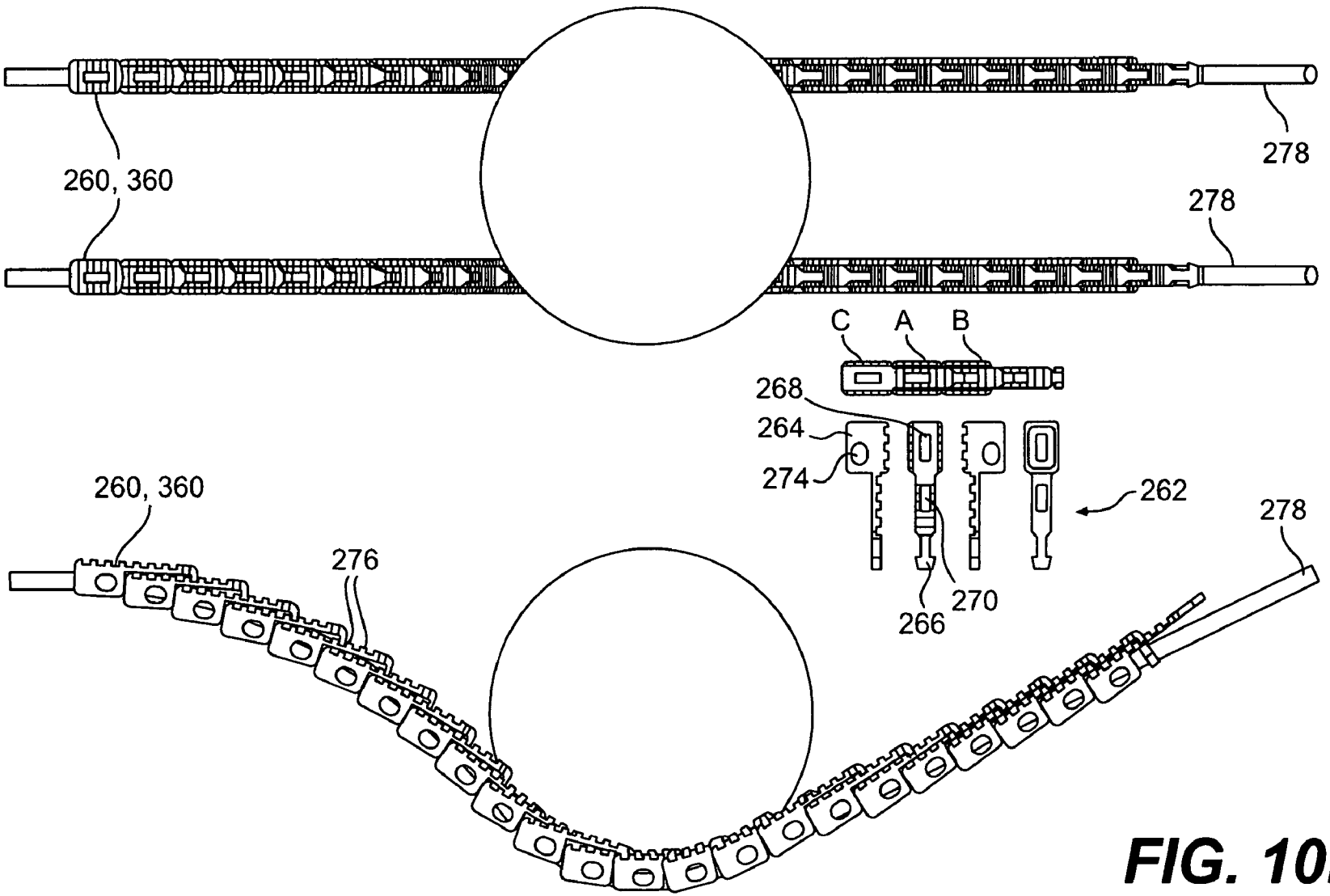

As an alternative or in addition to continuous flexible pocket member 250, a lacrosse head may include adjustable length flexible pocket members 260, as shown in FIGS. 10A-B. Adjustable length flexible pocket members 260 may comprise a length of inter-engaging elements 262. In a similar manner to the protrusions 254 of continuous flexible pocket member 250, the elements 262 of adjustable length flexible pocket member 260 provide more flexibility to member 260 when member 260 is forced in a direction toward the ball retaining side of the head and less flexibility when member 260 is forced in a direction toward the ball receiving side of the head. This variable flexibility is provided by the interlocking of tab 266 and notch 268, 270 elements on the top portion of the member 260 and the separability of body elements 264 on the bottom portion of the member 260.

Each of the inter-engaging elements 262 may include a body 264, a tab 266, a body notch 268, a tab notch 270, a longitudinal through-hole 272, and a lateral through-hole 274. To assemble the adjustable length flexible pocket member 260, a tab 266 of a first inter-engaging element A is inserted into a tab notch 270 of a second inter-engaging element B, as shown in FIGS. 10A-B. In so doing, the length of the tab 266 of the element A is aligned with the length of the tab notch 270 of the element B when it is inserted, and the element A is then rotated to lock the tab 266 of element A in the notch 270 of element B and to align the elements A and B. The first element A is then positioned so that its tab notch 270 lies over the body notch 268 of the second element B. A third inter-engaging element C is then provided and its tab 266 is simultaneously inserted into both the tab notch 270 of the first element A and the body notch 268 of the second element B. The third element C is then rotated to lock the tab 266 into the two notches 268, 270 of the elements B, A, respectively, and to align the body longitudinally. The process is then repeated for a fourth element (not shown) and so on until the adjustable length flexible pocket member 260 has reached a desired length.

FIGS. 10A-B also show strings 278 that are threaded through the series of longitudinal through-holes 272 formed by successive inter-engaging elements 262. These optional strings 278 may be inserted into the flexible pocket member 260 for added stability, form, or strength, as the user may find necessary. The lateral through-holes 274 may be used for cross-strings (not shown) or throwing strings (not shown) that may form the rest of the pocket. The flexible pocket members 260, cross-strings, and throwing strings may all be configured according to the specific needs of a user in order to achieve the ideal shape for the pocket.

As shown in FIG. 12, the flexible pocket members 250 may also include longitudinal through-holes 253 and lateral through-holes 256 to enable pocket strings to be threaded through the flexible members 250 in a similar manner as described above with respect to adjustable length flexible pocket members 260.

While the figures show an exemplary lacrosse head having flexible pocket members 250, 260 extending from the stop member 214 area to the scoop 212 area, the present invention also contemplates the flexible pocket members 250, 260 extending in other directions across the frame, such as laterally across the pocket. The flexible members 250, 260 may be attached to each of the sidewalls 208, 210 or any other appropriate member (e.g., stop or scoop) of the head to run across the width of the pocket. Such a configuration may provide the pocket with additional flexural capabilities, thus improving the catching and throwing characteristics of the lacrosse head.

The present invention further contemplates an embodiment in which the flexible members 250, 260 do not extend continuously from stop member 214 to scoop 212 or from sidewall 208 to sidewall 210. The flexible pocket members 250, 260 in accordance with this aspect of the invention may extend only partially across the pocket with one end attached to either the stop member 214, the scoop 212, or a sidewall 208, 210, or the flexible pocket member 250, 260 may not be attached to any part of the frame and may instead be wholly strung into the pocket. Alternatively, a lacrosse head may comprise a plurality of flexible pocket members 250, 260 that extend intermittently across a pocket such that more than one piece of the flexible pocket member 250, 260 extends along a single string line.

Additionally, flexible pocket members 250, 260, may include bumps, ridges, grooves, or nubs that may enhance ball grip. For example, as shown in FIG. 12, flexible pocket member 250 may include nubs 251 disposed along the length of the top portion 252 of the member 250. Likewise, individual inter-engaging elements 262 that form adjustable length flexible pocket member 260, as shown in FIGS. 10A-B, may include raised ridges 276 that enhance ball grip.

The adjustable length flexible pocket members 260 and the continuous flexible pocket members 250 may be formed of any suitably flexible material, such as urethane or an elastomer.

Figure 8:
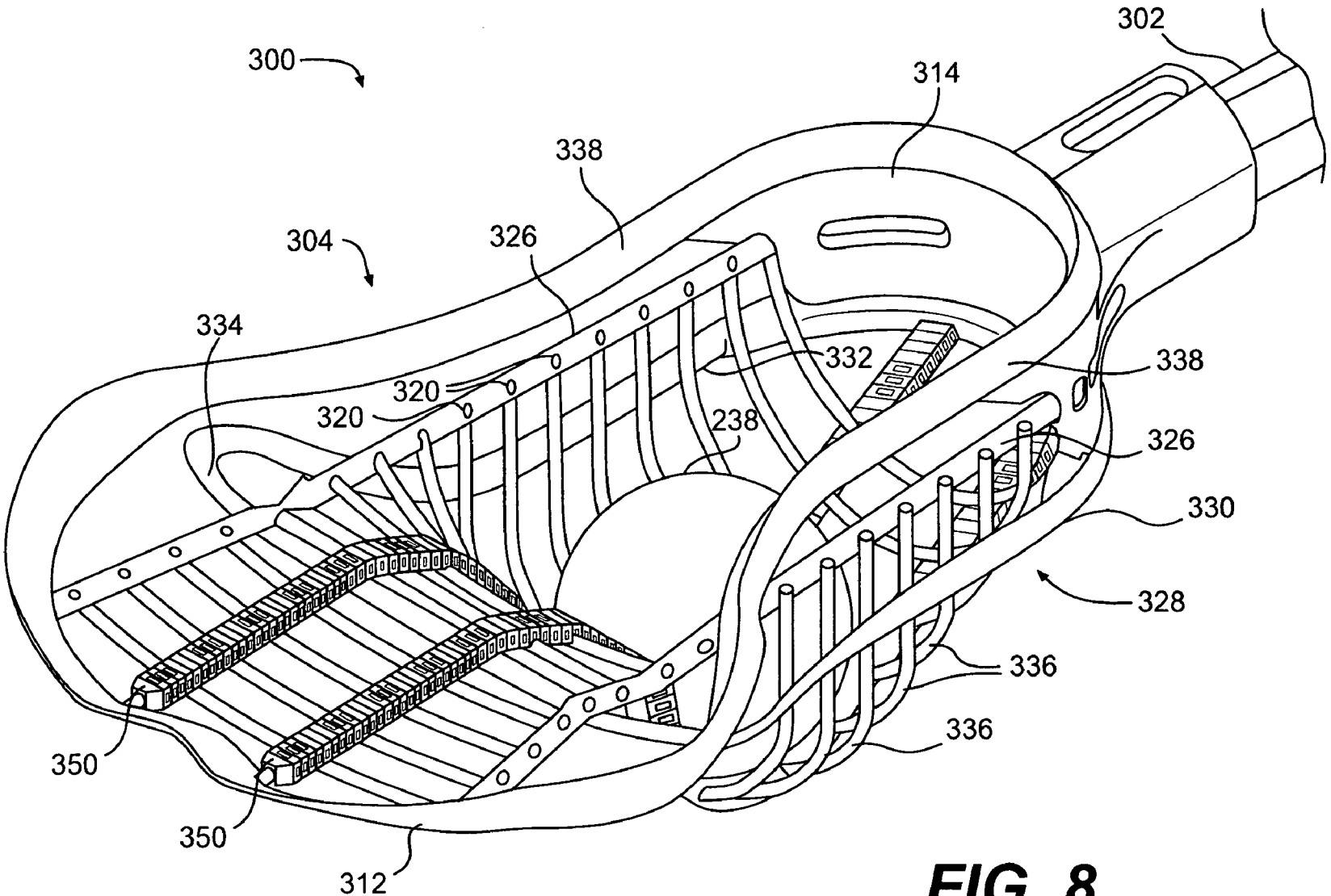
FIG. 8 is a schematic diagram illustrating a perspective view of an exemplary lacrosse stick having a recessed scoop, flexible stringing bars, flexible side rails, and flexible pocket members, according to another embodiment of the present invention.
Figure 9:
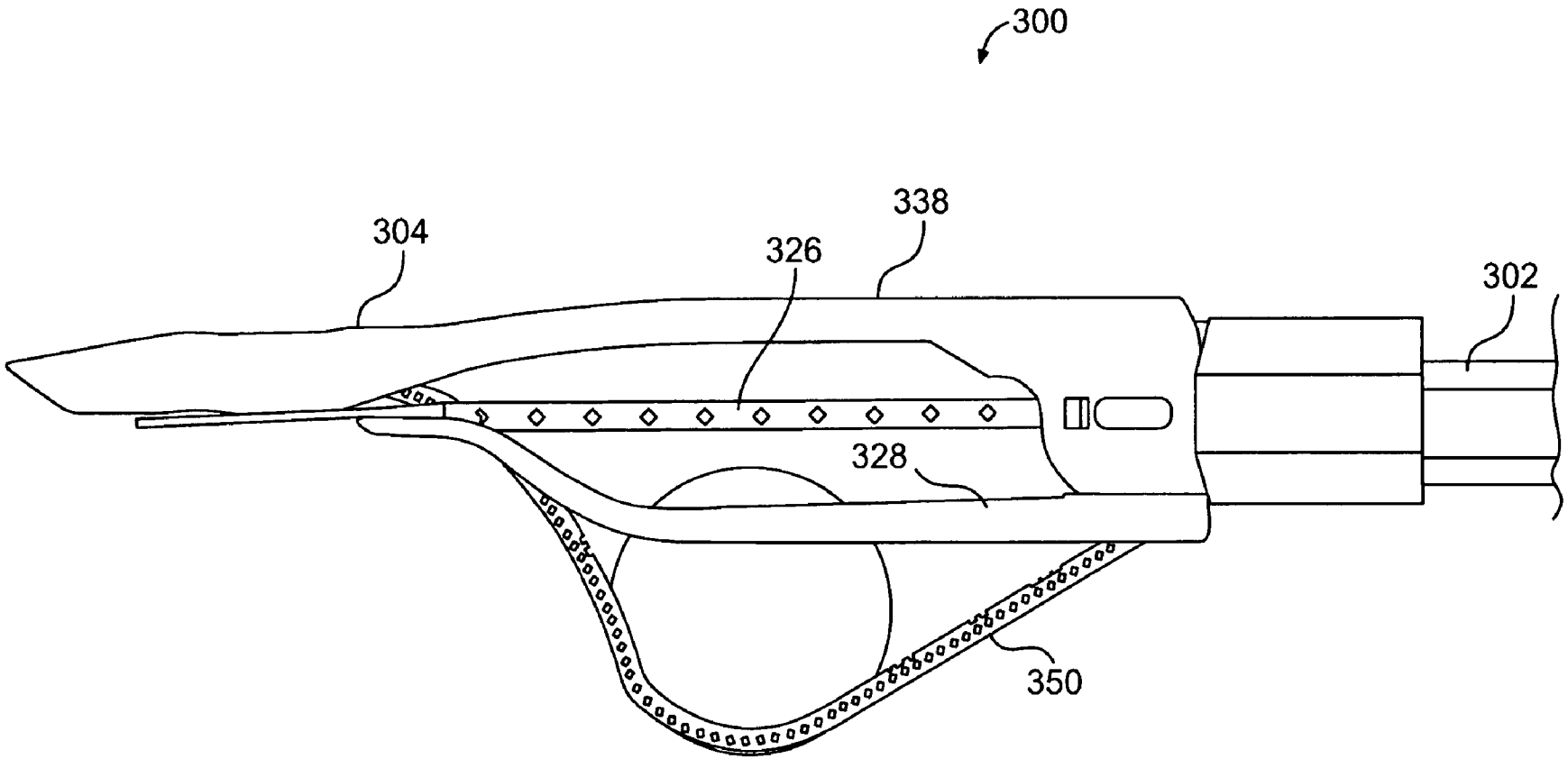
FIG. 9 is a schematic diagram illustrating a side view of the lacrosse stick shown in FIG. 8, according to an embodiment of the present invention.

FIGS. 8 and 9 illustrate an exemplary lacrosse stick 300 with a head 304 having a recessed scoop 312, flexible stringing bars 326, upper sidewalls 338, a flexible lower sidewall member 328, and flexible pocket members 350. The recessed scoop 312 has characteristics similar to the recessed scoop 212 in the embodiment of the invention depicted in FIGS. 2-7.

The flexible pocket members 350 may have the same characteristics as flexible pocket members 250 and are labeled as equivalents in FIGS. 11-13. Alternatively, adjustable length flexible pocket members 360, as shown in FIGS. 10A-B, are equivalent to the previously described adjustable length flexible pocket members 260 and may be used in addition to or instead of flexible pocket members 350 in the same way as is described above with reference to the interchangeability of adjustable length flexible pocket members 260 and continuous flexible pocket members 250. In either case, flexible pocket members 350 or 360, when oriented longitudinally (from stop member 314 to scoop 312), provide a guide track that may increase the accuracy and speed of a thrown ball, among other advantages.

FIG. 8 illustrates a rigid upper frame on the ball receiving side of head 304 comprised of upper sidewalls 338 and scoop 312, according to an embodiment of the present invention. Upper sidewalls 338 extend from stop member 314 and are connected on their sides opposite stop member 314 by scoop 312. Upper sidewalls 338 may have a cross-section that helps maximize rigidity and overall strength of the head 304, such as the triangular shape shown in FIG. 8. The scoop 312 may have a cross-section designed to accommodate the flexibility desired in scooping balls, such as a somewhat flat or oval shaped cross-section as shown in FIG. 8. The rigid triangular cross-section of upper sidewalls 338 gradually transitions into the flat or oval shaped cross-section of the scoop 312. This transition may be at the widest portion of the lacrosse head 304 or may be located at any other location along the head 304, such as at a location halfway between the stop member 314 and scoop 312. In this manner, this embodiment of the present invention can optimize the strength, rigidity, and flexibility of the upper frame of head 204 by combining rigid upper sidewalls 338 in the rear portion of the head (i.e., toward the stop member 314) with a more flexible scoop 312 in the forward portion of the head (i.e., toward the scoop 312). Such optimization can satisfy desired performance characteristics of the head 304, such as the ability to withstand and deliver checks while also allowing for flexibility in scooping balls.

The embodiment of the present invention shown in FIGS. 8 and 9 additionally includes a flexible lower sidewall member 328. The lower sidewall member 328 includes a left member 330 extending from stop member 314, a right member 332 extending from stop member 314, and a crosspiece 334 joining the left and right members 330, 332 at their ends opposite stop member 314. The lower sidewall member 328 enhances the ability of the lacrosse head to absorb shock imparted by a check from another stick, or from some other impact, and to better protect the ball 238 during catching, throwing, or cradling, as described in more detail below. The crosspiece 334 of the lower sidewall member 328 extends beneath the strung pocket and may act as a "throwing" or "shooting" bar, similar to a "throwing" or "shooting" string as used in traditional lacrosse pockets to increase the speed and accuracy of a thrown ball.

In one embodiment, lower sidewall member 328 is conveniently interchangeable with head 304. The lower sidewall member 328 may be interchangeable in that no pocket strings 336 are fixed to it and that the lower sidewall member 328 does not connect to the upper sidewall 338 except for their mutual connection to a stop member 314. The lower sidewall member 328 may be connected to the stop member 314 by a snap-in fitting, a set screw, or any other suitable fastening device.

To reduce the force imparted to the pocket of the lacrosse head 304, the width between the left and right members 330, 332 of lower sidewall member 328 may be larger than the width between upper sidewalls 338 such that a stick or other object moving toward the head 304 from the side or back will contact the lower sidewall member 328 first before contacting the upper sidewall 338. In this way, the lower sidewall member 328 may take an initial hit and flex to greatly reduce or eliminate the force transferred to the pocket and ball, since no strings 336 are attached to lower sidewall member 328 and there is a space between lower sidewall member 328 and the pocket, as seen in FIG. 8.

The head 304 may include flexible stringing bars 326 that support the pocket strings 336 and provide form to the pocket. The flexible stringing bars 326 may extend from an attachment point close to the stop member 314 to an attachment point located on or close to the scoop 312. In one embodiment, the flexible stringing bars 326 are disposed inwardly (toward the center of the head) of the upper sidewalls 338 and/or the lower sidewall member 328, which can provide, for example, a more narrow ball retaining structure in comparison to the wider ball receiving structure provided by the upper sidewalls 338. The flexible stringing bars 326 can also provide additional cushioning and flexure in the pocket when a ball is caught, thrown, or cradled, thus making the lacrosse head 304 more maneuverable and forgiving. The flexible stringing bars 326 may extend and lay over the crosspiece 334 in order to take advantage of their combined flexibility and guide track-forming characteristics. The flexible stringing bars 326 can be made of any suitably durable and flexible material, such as urethane or an elastomer.

In the embodiment shown in FIGS. 8 and 9, flexible pocket members 350 extend from stop member 314 to scoop 312 and the cross strings 336 extend from side to side and attach to the stringing bars 326 at string holes 320. In this manner, a ball guide track is formed by the flexible pocket members 350, which hang over the free-floating crosspiece 334 of the lower sidewall 328, and the amount of strings used is minimized. A further advantage of this arrangement is that the strings 336 are placed between the ball 238 and the lower sidewall member 328 so that rattling is reduced.

The present invention also contemplates an embodiment in which the flexible pocket members 350 extend from side to side and the cross strings 336 extend from stop member 314 to scoop 312. In either case, the cross strings 336 may be configured to pass through string holes in flexible pocket members 350 or 360 as described above with regard to flexible pocket members 250 and 260.

In alternative embodiment of the head 304 shown in FIGS. 8 and 9, lower sidewall member 328 does not include cross-piece 334, and instead includes only left and right members 330, 332 extending from stop member 314. In this embodiment, left and right members 330, 332 may terminate at a free end in the forward portion of head 204 near scoop 312.

Figure 14:
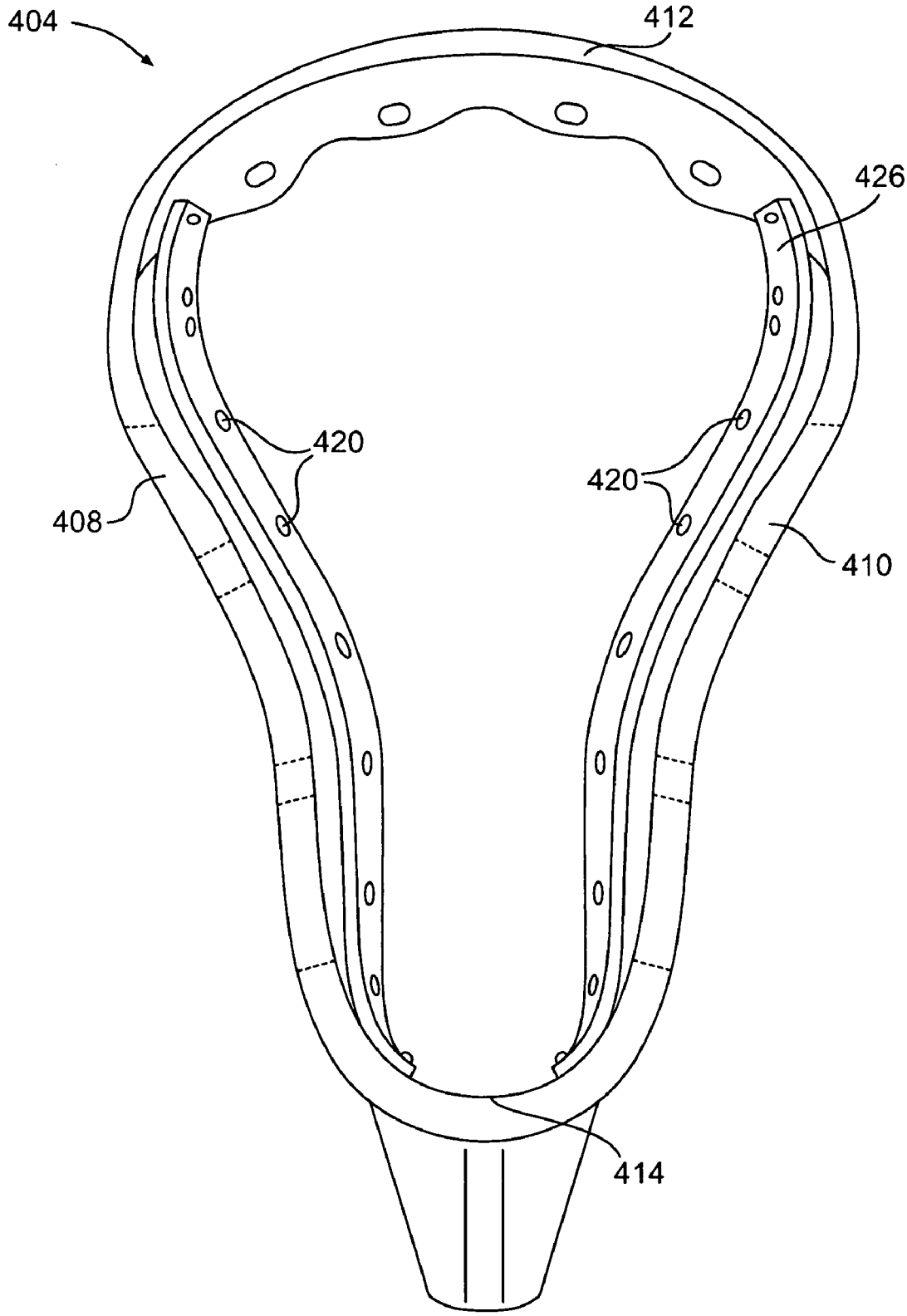
FIG. 14 is a schematic diagram illustrating a top view of the ball receiving side of an exemplary lacrosse head having flexible stringing bars from the stop member to the scoop, according to another embodiment of the present invention.

FIG. 14 is a schematic diagram of an exemplary lacrosse head 404 having flexible stringing bars 426 from the stop member 414 to the scoop 412, according to an embodiment of the present invention. As shown by this example, each stringing bar 426 can be attached to the scoop 412 and the stop member 414, and can span the lacrosse head frame 404 for substantially the length of a sidewall 408, 410. In spanning the frame 404, the stringing bars 426 can be inside the sidewalls 408, 410, i.e., the stringing bars 426 are above the lower edge (at the ball retaining side) and below the upper edge (at the ball receiving side) of the sidewalls 408, 410 when viewed from a side elevation. The stringing bars 426 can include thread holes 420 to which a pocket can be strung.

The stringing bars 426 can connect to the lacrosse head frame 404 in any number of ways including, for example, Christmas tree-type fasteners in two or more locations (e.g., lower and higher). In another embodiment, a stringing bar 426 could be part of a mesh pocket, with the stringing bar 426 attaching to the frame 404.

In one implementation, the stringing bar 426 is part of the manufactured head frame 404. In another implementation, the stringing bar 426 can be separately attached to the head frame 404 in different positions to enable customization. In another implementation, the flexible stringing bar 426 can hang below portions of the head frame 404 so that, in a strung head, the ball may be carried, for example, lower in the rear portion of the head (closer to the stop member) than in the forward portion of the head (closer to the scoop).

A lacrosse head 404 according to this embodiment could be adapted for men's lacrosse in that at least a portion of a ball resting in the pocket can be disposed above the lower edge of the frame 404 for compliance with the widely accepted rules of lacrosse.

Figure 15:
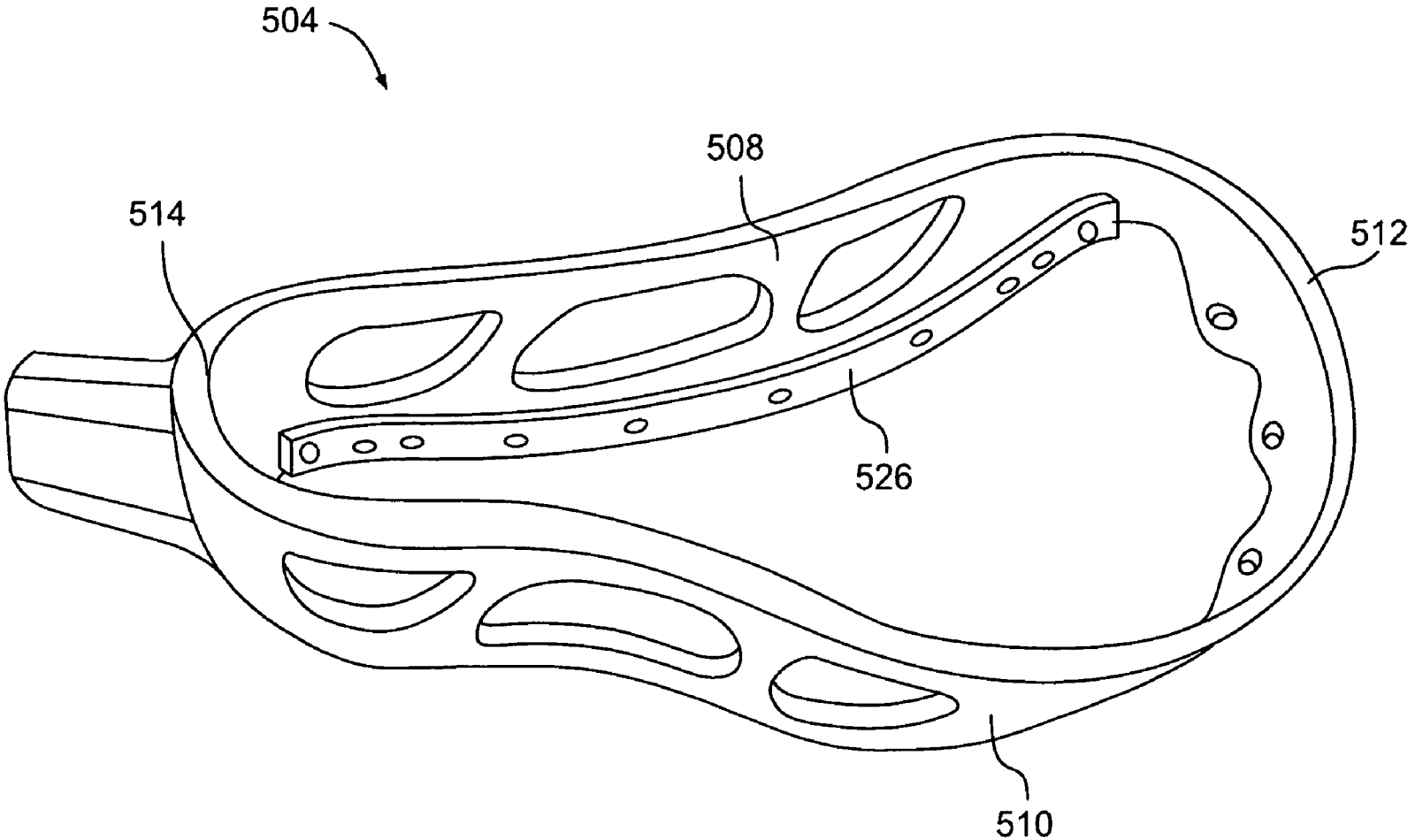
FIG. 15 is a schematic diagram illustrating a perspective side view of another exemplary lacrosse head having a flexible stringing bar disposed along a sidewall, according to an embodiment of the present invention.

FIG. 15 is a schematic diagram of another exemplary lacrosse head 504 having a flexible stringing bar 526 along a sidewall 508, according to an embodiment of the present invention. In comparison to the head 404 of FIG. 14, the head 504 of FIG. 15 illustrates slightly different attachment points and positioning. A flexible stringing bar 526 may be disposed on one or both of the sidewalls 508, 510.

Figure 16:
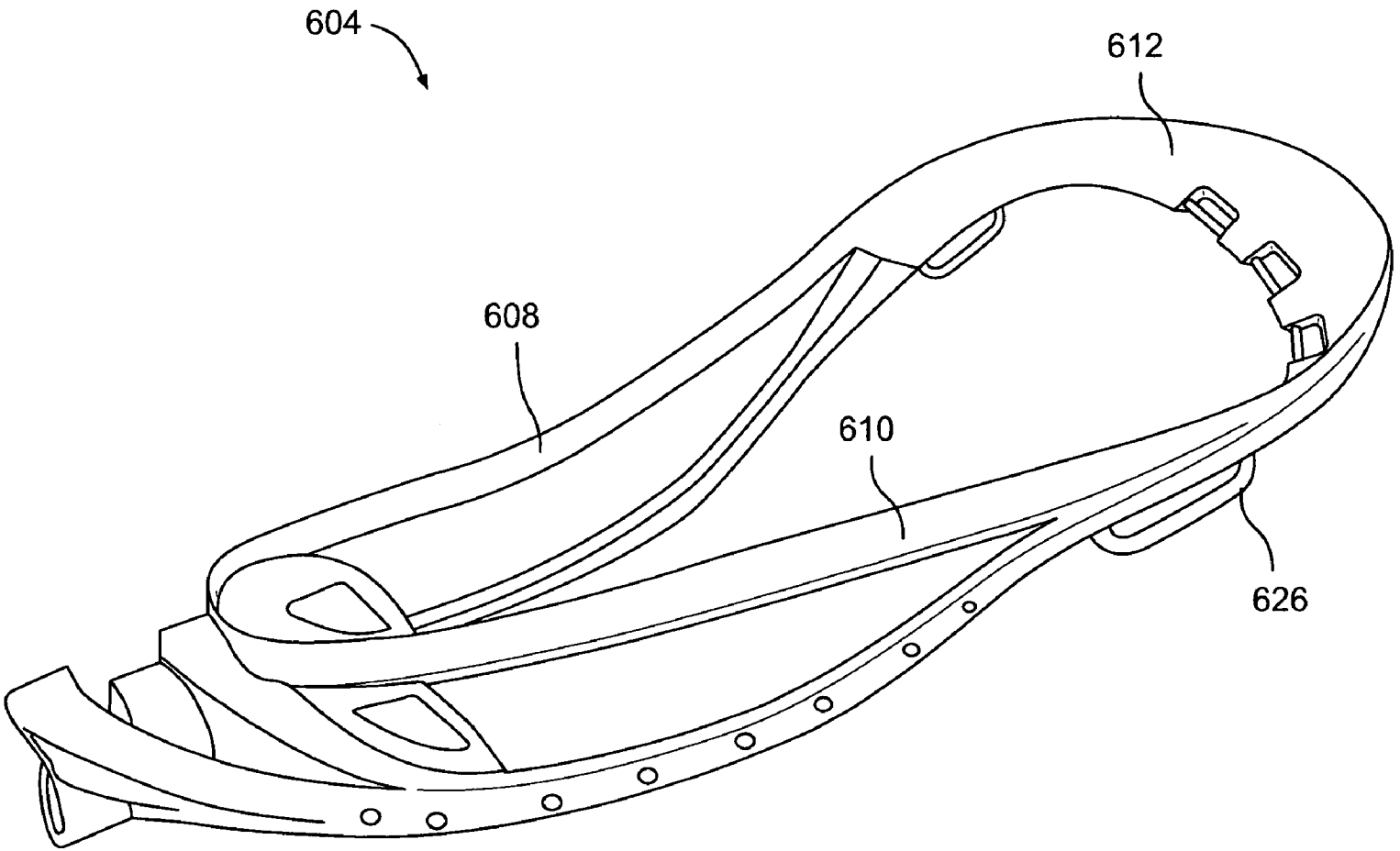
FIG. 16 is a schematic diagram illustrating a perspective side view of an exemplary lacrosse head having flexible stringing bars disposed on the lower edge of the upper sidewalls and near the scoop, according to another embodiment of the present invention.

FIG. 16 is a schematic diagram of an exemplary lacrosse head 604 having flexible stringing bars 626 disposed on the lower edge of the upper sidewalls 608, 610, in the forward portion of head 604 near the scoop 612, according to an embodiment of the present invention. The stringing bars 626 may be formed of a stiff material that allows little deflection or they may be formed of a material having relatively more flexibility, which would allow for greater deflection and, thus, a greater ability to absorb impact.

In an important aspect of the present invention, embodiments of the invention can both dampen and narrow a pocket to greatly enhance ball control. The dampening can occur primarily in response to a force directed toward the ball retaining side of the head, for example, when a ball is received into the head and hits the pocket. The dampening can also occur in other directions or combinations of directions within the head, such as laterally from sidewall to sidewall as the pocket is pulled during cradling. The flexible frame and pocket members described above, such as flexible stringing rails 226, 232, flexible stringing bars 326, and flexible pocket members 250, 350, 260, 360, can provide this dampening. The dampening prevents a trampoline effect that would propel the ball out of the pocket. In other words, in response to the pull of the pocket, the flexible members can flex, dampen the pull of the pocket, and then gradually recover to their original position without excessive rebound.

The narrowing of the pocket occurs as flexible members of the frame or pocket move in a direction generally toward the interior of the head. For example, with reference to FIG. 8, the flexible stringing bars 326 can flex toward each other (e.g., toward the centerline of head 304) when a ball is received in the pocket and can effectively narrow the pocket and help retain the ball within the pocket. The distance between the flexed bars 326 would be less than both the distance between the bars 326 in their non-flexed position and also the distance between the upper sidewalls 338. This narrowing can occur simultaneously with the dampening of the pocket in response to a force in the direction from the ball receiving side of the head toward the ball retaining side of the head (e.g., a force from a ball entering the head and pocket). As another example, the flexible stringing rails 226 in FIG. 2 could also be configured to flex toward the interior of the head and effectively narrow the pocket. Thus, the present invention can dampen the force of a ball entering a head, as well as narrow the pocket to retain the ball in the head.

As one of ordinary skill in the art would appreciate, any of the heads 204, 304, 404, 504, or 604 depicted in the figures may be strung with either a traditional thong and cross-string type pocket or a mesh pocket, and may in either case retain the advantages of the disclosure.

In addition, although the above embodiments of the present invention describe flexible members (e.g., flexible pocket members, flexible stringing rails, and flexible stringing bars) as disposed in certain locations of the head, one of ordinary skill in the art would appreciate that these flexible members could be provided in any location of a head appropriate for providing the desired performance characteristics. For example, a flexible stringing rail similar to the rails 232, 226 of FIG. 2 could be provided in the stop member of head 204. Likewise, a flexible stringing bar similar to the bars 326 of FIG. 8 could be provided at the stop member of head 304, for example, attaching both ends of the bar to two different locations on the stop member. As another example, a flexible stringing bar similar to the bars 326 of FIG. 8 could be provided at the scoop of head 304, for example, attaching both ends of the bar to two different locations on the scoop.

Examples of suitable materials for a lacrosse head according to the present invention include nylon, composite materials, elastomers, metal, urethane, polycarbonate, polyethylene, polypropylene, polyketone, polybutylene terephalate, acetals (e.g., Delrin™ by DuPont), acrylonitrile-butadiene-styrene (ABS), acrylic, acrylic-styrene-acrylonitrile (ASA), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), and polyvinyl chloride (PVC).

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A lacrosse head comprising:

a stop member;

a first sidewall extending from the stop member;

a second sidewall extending from the stop member; and a scoop connecting the first sidewall and the second sidewall opposite to the stop member, at least one of the stop member, the first sidewall, the second sidewall, and the scoop having a flexible pocket member attached thereto, wherein the flexible pocket member is configured to flex more in a first direction generally from a ball receiving side of the lacrosse head to a ball retaining side of the lacrosse head than in a second direction generally from the ball retaining side of the lacrosse head to the ball receiving side of the lacrosse head, wherein the stop member, the first and second sidewalls, and the scoop enclose an interior of the lacrosse head, further comprising:

a first stringing member attached to at least one of the stop member, the first sidewall, the second sidewall, and the scoop, a second stringing member attached to at least one of the stop member, the first sidewall, the second sidewall, and the scoop, and a pocket attached to the first stringing member and the second stringing member, wherein the first and second flexible stringing member move toward each other in a direction toward the interior of the lacrosse head to narrow the pocket, wherein the first stringing member is attached to the stop member and the scoop and disposed inwardly of the first sidewall, wherein the second stringing member is attached to the stop member and the scoop and disposed inwardly of the second sidewall, and wherein the first and second stringing members respectively comprise one of first and second flexible stringing bars and first and second flexible stringing rails.

2. The lacrosse head of claim 1, wherein a slot is formed between a flexible stringing rail of the first and second flexible stringing rails, and the at least one of the stop member, the first sidewall, the second sidewall, and the scoop, the slot extending substantially along the at least one of the stop member, the first sidewall, the second sidewall, and the scoop.

3. The lacrosse head of claim 2, wherein the slot is formed between the flexible stringing rail and the scoop, and wherein the scoop and the flexible stringing rail overlap each other such that no through passage is visible through the slot when viewed in a direction facing a ball receiving side of the head.

4. The lacrosse head of claim 2, wherein the slot tapers inwardly toward the interior of the lacrosse head.

5. The lacrosse head of claim 2, wherein the slot forms a tear-drop shape at an end.

6. The lacrosse head of claim 2, wherein the flexible stringing rail defines a first hole and the at least one of the stop member, the first sidewall, the second sidewall, and the scoop defines a second hole, the first hole and the second hole being aligned.

7. The lacrosse head of claim 6, wherein the first hole and the second hole are separated by a gap, and wherein the lacrosse head further comprises an attachment member threaded through the first hole and the second hole to selectively adjust the size of the gap.

8. The lacrosse head of claim 1, wherein the scoop has a recess along its edge disposed farthest from the stop member.

9. The lacrosse head of claim 8, wherein the recess is configured to allow the scoop to make initial contact with a ball at least at two locations when a ball is scooped.

10. The lacrosse head of claim 8, wherein, when viewed in a direction facing the ball receiving side of the head, the recess is substantially aligned with a shaft axis of the lacrosse head and curves toward the stop member.

11. The lacrosse head of claim 10, wherein the recess has a radius of curvature less than about 0.9 inches.

12. The lacrosse head of claim 10, wherein the recess has an area of about 0.02 to about 4.5 square inches when viewing the lacrosse head in a direction facing its ball receiving side.

13. The lacrosse head of claim 10, wherein the recess has a depth of about 0.2 to about 1.4 inches when viewing the lacrosse head in a direction facing its ball receiving side.

14. The lacrosse head of claim 8, wherein the scoop has a substantially flat portion on a ball retaining side of the head, the substantially flat portion defining a plane that forms an angle with the shaft axis of the lacrosse head of approximately 20 to 40 degrees.

15. The lacrosse head of claim 1, the first and second sidewalls disposed on a ball receiving side of the lacrosse head, the lacrosse head further comprising:

a third sidewall extending from the stop member and disposed on a ball retaining side of the lacrosse head;

a fourth sidewall extending from the stop member and disposed on the ball retaining side of the lacrosse head; and a crosspiece connecting the third sidewall and the fourth sidewall opposite to the stop member.

16. The lacrosse head of claim 15, wherein a distance between the first sidewall and the second sidewall is less than a distance between the third sidewall and the fourth sidewall.

17. The lacrosse head of claim 15, wherein crosspiece comprises a free-floating member.

18. The lacrosse head of claim 15, wherein the crosspiece is disposed closer to the stop member than is the scoop.

19. The lacrosse head of claim 15, further comprising a pocket, the pocket being attached to at least one of the stop member, the first sidewall, the second sidewall, the scoop, the first stringing member, and the second stringing member, the pocket not being attached to the third sidewall, the fourth sidewall, and the crosspiece.

20. The lacrosse head of claim 15, wherein the flexible pocket member extends from the stop member to the scoop, and lies on top of the crosspiece.

21. The lacrosse head of claim 1, wherein the flexible pocket member extends from the stop member to the scoop, wherein the lacrosse head further comprises a second flexible pocket member extending from the stop member to the scoop, and wherein the flexible pocket member and the second flexible pocket member form a ball guide track.

22. The lacrosse head of claim 1, wherein the flexible pocket member comprises a plurality of inter-engaging elements.

23. The lacrosse head of claim 22, wherein each of the inter-engaging elements comprises a tab and at least one notch, and wherein a tab of a first inter-engaging element engages a notch of a second inter-engaging element adjacent to the first inter-engaging element.

24. The lacrosse head of claim 1, wherein the flexible pocket member comprises a continuous piece of material.

25. The lacrosse head of claim 24, wherein a side of the continuous piece of material has a plurality of protrusions, the protrusions configured to contact each other when the flexible pocket member flexes in the second direction and to separate from each other when the flexible pocket member flexes in the first direction.

26. The lacrosse head of claim 1, further comprising a string longitudinally threaded through the flexible pocket member.

27. The lacrosse head of claim 1, further comprising a string laterally threaded through the flexible pocket member.

28. A lacrosse head comprising:

a stop member;

a first sidewall extending from the stop member;

a second sidewall extending from the stop member;

a scoop connecting the first sidewall and the second sidewall opposite to the stop member;

two stringing members connected to the lacrosse head, the two stringing members extending in a direction generally parallel to a shaft axis of the lacrosse head when viewed in a direction facing a ball receiving side of the lacrosse head; and a pocket attached to the two stringing members, wherein the two stringing members flex toward each other and in a direction from the ball receiving side of the lacrosse head to a ball retaining side of the lacrosse head in response to a force on the pocket in a direction from the ball receiving side of the lacrosse head to the ball retaining side of the lacrosse head, wherein the pocket is not secured to the stop member, the first sidewall, the second sidewall, or the scoop.

29. A lacrosse head comprising:

a stop member;

a first sidewall extending from the stop member;

a second sidewall extending from the stop member;

a scoop connecting the first sidewall and the second sidewall opposite to the stop member;

two stringing members connected to the lacrosse head, the two stringing members extending in a direction generally parallel to a shaft axis of the lacrosse head when viewed in a direction facing a ball receiving side of the lacrosse head;

a pocket attached to the two stringing members, wherein the two stringing members flex toward each other and in a direction from the ball receiving side of the lacrosse head to a ball retaining side of the lacrosse head in response to a force on the pocket in a direction from the ball receiving side of the lacrosse head to the ball retaining side of the lacrosse head;

a flexible sidewall member disposed, relative to the first sidewall and the second sidewall, closer to the ball retaining side of the lacrosse head, the flexible sidewall member comprising:

a left flexible sidewall member;

a right flexible sidewall member; and a crosspiece connecting the left flexible sidewall member and the right flexible sidewall member, wherein the distance between the left flexible sidewall member and the right flexible sidewall member is greater than the distance between the first sidewall and the second sidewall.

* * * * *